US009039882B2

(12) United States Patent
Kawagoshi et al.

(10) Patent No.: US 9,039,882 B2
(45) Date of Patent: May 26, 2015

(54) METAL MATERIAL WITH A BISMUTH FILM ATTACHED AND METHOD FOR PRODUCING SAME, SURFACE TREATMENT LIQUID USED IN SAID METHOD, AND CATIONIC ELECTRODEPOSITION COATED METAL MATERIAL AND METHOD FOR PRODUCING SAME

(71) Applicant: Nihon Parkerizing Co., Ltd., Chuo-ku, Tokyo (JP)

(72) Inventors: Ryosuke Kawagoshi, Kanagawa (JP); Hitoshi Ishii, Kanagawa (JP)

(73) Assignee: NIHON PARKERIZING CO., LTD., Chuo-ku, Tokyo (JP)

( * ) Notice: Subject to any disclaimer, the term of this patent is extended or adjusted under 35 U.S.C. 154(b) by 0 days.

(21) Appl. No.: 14/491,419

(22) Filed: Sep. 19, 2014

(65) Prior Publication Data

US 2015/0013566 A1 Jan. 15, 2015

Related U.S. Application Data

(62) Division of application No. 12/736,958, filed as application No. PCT/JP2009/059255 on May 20, 2009, now abandoned.

(30) Foreign Application Priority Data

May 29, 2008 (JP) ..... 2008-140955

(51) Int. Cl.
*C23C 30/00* (2006.01)
*C23C 22/50* (2006.01)
(Continued)

(52) U.S. Cl.
CPC ..... *C23C 30/005* (2013.01); *Y10T 428/13* (2015.01); *Y10T 428/12389* (2015.01);
(Continued)

(58) Field of Classification Search
CPC ..... C23C 22/50; C23C 22/53; C23C 22/56; C23C 22/83; C23C 18/54; C23C 30/005; C23C 18/1637; C25D 13/20; Y10T 428/12681; Y10T 428/13; Y10T 428/12389
See application file for complete search history.

(56) References Cited

U.S. PATENT DOCUMENTS 2,881,121 A * 4/1959 Kardos et al. ..... 205/294
3,932,198 A 1/1976 Schneider
(Continued)

FOREIGN PATENT DOCUMENTS

DE 10 2005 059 314 A1 6/2007
JP 10-501027 A 1/1998
(Continued)

OTHER PUBLICATIONS

Second Office Action of the Canadian Patent Office issued in Canada Application No. 2 725 108, in the English language, dated Oct. 26, 2012 (3 pages).
(Continued)

*Primary Examiner* — Kishor Mayekar
(74) *Attorney, Agent, or Firm* — Flynn, Thiel, Boutell & Tanis, P.C.

(57) ABSTRACT

A metal material is provided with a bismuth coating which enables the subsequent coating to be accomplished at a high throwing power, and has excellent corrosion resistance, coating adhesion and is able to be produced with reduced damage to the environment. The metal material has a surface and a bismuth-containing layer deposited on at least a part of the surface of the metal material, wherein the percentage of bismuth atoms in the number of atoms in the surface layer of the metal material with a bismuth coating is at least 10%.

14 Claims, 3 Drawing Sheets

ETCHING OF THE SUBSTRATE → DEPOSITION OF BISMUTH $$3Fe+2Bi^{3+} \rightarrow 3Fe^{2+}+2Bi$$

(51) Int. Cl.

| | |
|---|---|
| ***C23C 22/53*** | (2006.01) |
| ***C23C 22/56*** | (2006.01) |
| ***C23C 22/83*** | (2006.01) |
| ***C25D 13/20*** | (2006.01) |
| ***C23C 18/16*** | (2006.01) |
| ***C23C 18/54*** | (2006.01) |

(52) U.S. Cl.
CPC ..... *Y10T 428/12681* (2015.01); *C23C 22/50* (2013.01); *C23C 22/53* (2013.01); *C23C 22/56* (2013.01); *C23C 22/83* (2013.01); *C25D 13/20* (2013.01); *C23C 18/1637* (2013.01); *C23C 18/54* (2013.01)

(56) References Cited

U.S. PATENT DOCUMENTS

| | | | |
|---|---|---|---|
| 4,539,265 | A | 9/1985 | Yazawa |
| 5,306,335 | A | 4/1994 | Senda et al. |
| 5,554,211 | A | 9/1996 | Bokisa et al. |
| 5,773,090 | A | 6/1998 | Buettner et al. |
| 5,936,013 | A | 8/1999 | Feola et al. |
| 6,331,201 | B1 | 12/2001 | McGrath et al. |
| 6,436,201 | B1 | 8/2002 | Sugita et al. |
| 6,624,215 | B1 | 9/2003 | Hiraki et al. |
| 7,625,476 | B2 | 12/2009 | Shimoda et al. |
| 2004/0170840 | A1 | 9/2004 | Matsukawa et al. |
| 2004/0187967 | A1 | 9/2004 | Matsukawa et al. |
| 2006/0286398 | A1 | 12/2006 | Achim et al. |
| 2008/0302448 | A1 | 12/2008 | Frey et al. |
| 2009/0169903 | A1 | 7/2009 | Kubota |

FOREIGN PATENT DOCUMENTS

| | | | |
|---|---|---|---|
| JP | 2000-087252 | | 3/2000 |
| JP | 2003-105553 | A | 4/2003 |
| JP | 2004-218073 | A | 8/2004 |
| JP | 2004-218075 | A | 8/2004 |
| JP | 2006-183079 | A | 7/2006 |
| JP | 2008-150654 | A | 7/2008 |
| JP | 2009-174049 | A | 8/2009 |
| WO | WO 2009-081807 | A1 | 7/2009 |

OTHER PUBLICATIONS

Third Office Action of the Canadian Patent Office issued in Canada Application No. 2 725 108, in the English language, dated Sep. 11, 2013 (3 pages).

European Search Report of European Patent Office issued in European Application No. 09 75 4596, in the English language, issued Oct. 9, 2013 (7 pages).

Canadian Office Action dated Feb. 1, 2012.

* cited by examiner

ETCHING OF THE SUBSTRATE → DEPOSITION OF BISMUTH $$3Fe+2Bi^{3+} \rightarrow 3Fe^{2+}+2Bi$$

METAL MATERIAL WITH A BISMUTH FILM ATTACHED AND METHOD FOR PRODUCING SAME, SURFACE TREATMENT LIQUID USED IN SAID METHOD, AND CATIONIC ELECTRODEPOSITION COATED METAL MATERIAL AND METHOD FOR PRODUCING SAME

This is a divisional of prior U.S. application Ser. No. 12/736,958, which was the national stage of International Application No. PCT/JP2009/059255, filed May 20, 2009.

TECHNICAL FIELD

This invention relates to a metal material with a bismuth coating and its production method, a surface-treating solution used therefor and a cationic electrodeposition metal material, and its production method.

BACKGROUND ART

A metal material is often provided with an overlying coating, for example, for improving its corrosion resistance or some design purpose. In most cases, a chemical conversion film is present between the coating formed by the coating and the metal material, and this chemical conversion film greatly improves the corrosion resistance and an adhesion properties of the coating. The chemical conversion film is formed on the surface of the metal material by the process called "chemical conversion" which is accomplished by bringing the surface of the metal material with a chemical agent called "chemical conversion solution". Examples of the chemical conversion known in the art that are used for imparting the metal material with corrosion resistance and coating adhesion include chromate treatment, zinc phosphate treatment, and zirconium-based treatment.

Among these, in the case of chromate treatment, hexavalent chromium is present in both the solution used for the chemical conversion and in the resulting chemical conversion film. As a consequence, use of the chromate treatment is limited by environmental reasons. In addition, use of the chromate treatment was difficult for structure which was partly formed from an iron or steel material since coating weight was not sufficient when used for an iron-based material while it was effective for use with a zinc-plated material or an aluminum alloy material.

Zinc phosphate treatment is effective not only for the zinc-based plated materials and aluminum alloy materials but also for iron and steel materials, and this treatment is also quite adequate as an undercoat for various coatings, and in particular, in the case of cationic electrodeposition. However, the solution used in the zinc phosphate treatment contains phosphorus which is a eutrophic element as well as nickel which has the risk of carcinogenicity. Treatment with zinc phosphate is also associated with the generation of industrial waste called "sludge" as the byproduct, and the trend has been against the use of this treatment for environmental concern.

In contrast, zirconium-based chemical conversion is capable of forming the required amount of coating on various materials with improved corrosion resistance and coating adhesion, and such effects are realized with reduced damage on the environment.

As an example of such zirconium-based chemical conversion, Patent Literature 1 discloses a chemical conversion agent comprising at least one member selected from the group consisting of zirconium, titanium, and hafnium; fluorine; and an agent for imparting the adhesion and the corrosion resistance, in which the agent for imparting adhesion and corrosion resistance is at least one member selected from the group consisting of an ion of a metal such as zinc, an alkaline earth metal ion, an ion of a metal in Group III in the periodic table, copper ion, and a silicon-containing compound.

Patent Literature 2 discloses a chemical conversion agent comprising at least one member selected from the group consisting of zirconium, titanium, and hafnium; fluorine; an agent for imparting adhesion, and a chemical conversion accelerator, in which the agent for imparting adhesion is at least one member selected from the group consisting of an ion of a metal such as zinc, an alkaline earth metal ion, an ion of a metal in Group III in the periodic table, copper ion, a silicon-containing compound, a water-soluble resin, a water-soluble epoxy compound, a silane coupling agent, and/or hydrolysate thereof. The unique feature of Patent Literature 2 is the chemical conversion promoter.

Both Patent Literature 1 and Patent Literature 2 further disclose a surface treated metal having a chemical conversion film formed by using such chemical conversion agent on its surface. As the metal substrate of the surface treated metal, Patent Literature 1 and Patent Literature 2 disclose an iron-based substrate, an aluminum-based substrate, and a zinc-based substrate, and with regard to the shape of the metal substrate, they only disclose simple plate shape. Patent Literature 1 and Patent Literature 2 also describe that the coating that may be deposited on the metal substrate having the chemical conversion film formed by using the chemical conversion agent is not particularly limited, and exemplary coatings include cationic electrodeposition and powder coating.

Such zirconium-based chemical conversion is capable of forming the required amount of chemical conversion film on various metal materials to impart the metal material with corrosion resistance, and the film can be formed with reduced damage to the environment. In the case of the zirconium-based chemical conversion, coating adhesion after the cationic electrodeposition is also improved.

CITATION LIST

Patent Literature

Patent Literature 1: JP 2004-218073 A
Patent Literature 2: JP 2004-218075 A

SUMMARY OF INVENTION

Technical Problems

However, when the metal material is a metal material having a pocket structure as in the case of an automobile body and this material is treated by the zirconium-based chemical conversion, it would be difficult to realize a high throwing power in the subsequent cationic electrodeposition. More specifically, high throwing power can not be attained by merely using the chemical conversion agent disclosed in Patent Literature 1 or Patent Literature 2 to the metal material having a pocket structure.

As will be described later in detail, the term "throwing power" as used herein means the property of the metal material that allows necessary amount of coating to be formed even in the interior of the pocket structure where formation of the coating by electrodeposition is difficult due to the reduced current, and hence, reduced current density; and accordingly, the term "throwing power" simultaneously means the property of the metal material that allows a relatively uniform coating to be formed on the its entire surface.

In contrast, the coating can be applied at a relatively higher throwing power when the metal material having a pocket structure is treated by zinc phosphate compared to the treatment by zirconium-based chemical conversion. The treatment using the zinc phosphate, however, suffers from the environmental problems as described above.

In view of the situation as described above, an object of the present invention is to provide a metal material with a bismuth coating which enables the subsequent coating to be accomplished at a high throwing power, which has excellent corrosion resistance and coating adhesion, and which can be produced with reduced damage to the environment. Another object of the present invention is to provide a production method for such a metal material with a bismuth coating.

A further object of the present invention is to provide a surface-treating solution which has high throwing power, and which is capable of providing the metal material with excellent corrosion resistance and coating adhesion with reduced damage to the environment.

A still further object of the present invention is to provide a metal material having a coating formed by cationic electrodeposition which has a uniform coating formed on its surface, which has excellent corrosion resistance and coating adhesion, and which can be produced with reduced damage to the environment. A still further object of the present invention is to provide a production method for such metal material.

Solution to Problems

To attain the above described objects, this invention provides (1) a metal material with a bismuth coating comprising a metal material having a surface and a bismuth-containing layer deposited on at least a part of the surface of the metal material, wherein a percentage of bismuth atoms in number of atoms in the surface layer of the metal material with a bismuth coating is at least 10%. Wherein, preferably (2) the metal material with a bismuth coating wherein the metal material has a pocket structure. Also preferably (3) the metal material with a bismuth coating wherein the bismuth-containing layer is formed in a shape of islands on the surface of the metal material.

To attain the above described objects, this invention provides (4) a metal material having a coating formed by cationic electrodeposition, comprising the metal material with a bismuth coating, and the coating formed by cationic electrodeposition on the bismuth coating of the metal material.

Also it provides (5) a surface-treating solution for use in a chemical conversion of a metal material surface conducted as a pretreatment of coating, wherein the surface-treating solution contains bismuth and a ligand (L1) for the bismuth. Wherein, preferably (6) the surface-treating solution wherein said coating is by cationic electrodeposition. Also wherein preferably (7) the surface-treating solution further comprising a brightener. Preferably (8) the surface-treating solution wherein the brightener is an organic compound having at least one member selected from the group consisting of aromatic ring, sulfone group, formyl group, carboxy group, and amino group. Preferably (9) the surface-treating solution wherein the solution at the time of the surface treatment contains the brightener at a weight concentration of 10 to 10,000 ppm. And preferably (10) the surface-treating solution wherein the ligand (L1) is aminopolycarboxylic acid and/or a carboxylic acid, and the solution contains at least one ligand which has stability for bismuth higher than stability for an ion of a metal constituting the metal material. And preferably (11) the surface-treating solution wherein the ligand (L1) is aminopolycarboxylic acid and/or a carboxylic acid, and has stability for bismuth higher than stability for an ion of a metal constituting the metal material, and the solution further comprises a ligand (L2) which has a stability for the ion of the metal constituting the metal material higher than the stability for bismuth. Wherein preferably (12) the surface-treating solution wherein the solution at the time of the surface treatment contains the bismuth at a weight concentration of 5 to 1,000 ppm. Preferably (13) the surface-treating solution wherein the solution at the time of the surface treatment contains the ligand at a weight concentration of 5 to 25,000 ppm. Preferably (14) the surface-treating solution having a pH of at least 2 and less than 10.5.

To obtain such object it provides (15) a method for producing a metal material with a bismuth coating, comprising the step of treating a surface of the metal material with the surface-treating solution to form a bismuth-containing layer on at least a part of the metal material surface. Preferably (16) the method for producing the metal material with a bismuth coating.

It provides (17) a method for producing a metal material having a coating formed by cationic electrodeposition, comprising the step of forming a coating by cationic electrodeposition on a surface of the metal material with a bismuth coating produced by the method for producing a metal material with a bismuth coating. It provides (18) the surface-treating solution consisting essentially of a water soluble bismuth compound, a ligand (L1) for the bismuth, a brightener, a fluoride ion, inevitable impurities and water. (19) the surface-treating solution of (18) wherein the solution does not contain a water soluble compound of $Sn^{+2}$ (tin having valency of 2). When the surface-treating solution contains such tin, the obtained surface treated layer also has such tin, therefore the corrosion resistance of the obtained metal material would be inferior. (20) the surface-treating solution of (18) wherein the solution does not contain any peroxides.

Advantageous Effects of Invention

The metal material with a bismuth coating of the present invention enables the subsequent coating to be accomplished at a high throwing power, and it has excellent corrosion resistance and coating adhesion. Also, this metal material can be produced with reduced damage to the environment.

The surface-treating solution of the present invention has a high throwing power, and this solution is also capable of providing the metal material with excellent corrosion resistance and coating adhesion with reduced damage to the environment.

The method for producing a metal material with a bismuth coating of the present invention is capable of producing a metal material which allows the subsequent coating to be accomplished at a high throwing power, and which has excellent corrosion resistance and coating adhesion. The production can be accomplished with reduced damage to the environment.

The metal material having a coating formed by cationic electrodeposition of the present invention has a uniform coating formed on its surface, and it has excellent corrosion resistance and coating adhesion. This metal material can also be produced with reduced damage to the environment.

The method for producing the metal material having a coating formed by cationic electrodeposition of the present invention is capable of producing a metal material having a uniform coating formed on its surface with reduced damage to the environment. It has excellent corrosion resistance and coating adhesion.

DESCRIPTION OF EMBODIMENTS

Figure 1:
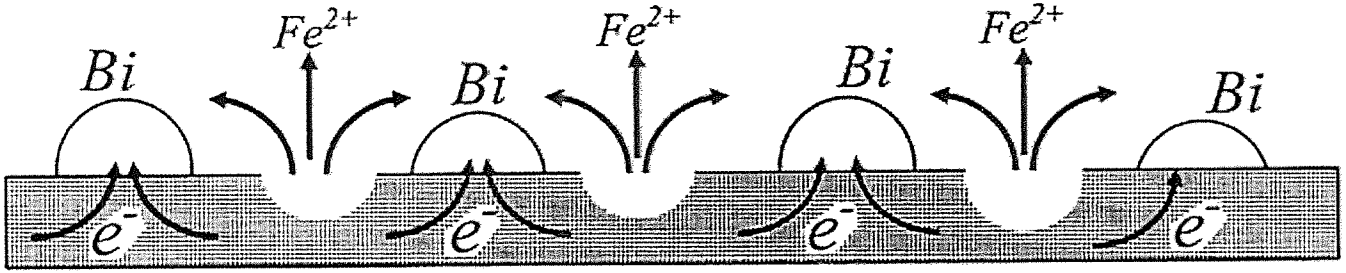
FIG. 1 is a view explaining the mechanism by which a bismuth coating is formed by the method for producing a metal material with a bismuth coating of the present invention.

Next, the present invention is described in detail. The metal material with a bismuth coating of the present invention is a metal material comprising a metal material substrate having a surface and a bismuth-containing layer deposited on at least a part of the surface of the metal material substrate, and the percentage of bismuth atom in the number of atoms in the surface layer of the metal material with a bismuth coating is at least 10%.

The metal material substrate used in the present invention is not particularly limited for its shape, and the present invention is well adapted for use with a metal material substrate having a pocket structure. In the following description, the term "metal material" is also used instead of the "metal material substrate" for simplicity.

The metal material (substrate) having a pocket structure includes a material having a complicated shape such as automobile body, and it has a part (the part of the pocket structure) where formation of the coating by electrodeposition is difficult even by the cationic electrodeposition due to the difficulty of establishing the electric current in such part.

Examples of the metal material having a pocket structure include automobile body, automobile parts, building materials, parts of a construction machine, parts of a material handling machine, and steel furniture's.

Also, the metal material is not particularly limited for its type (material type), and it may also comprise two or more metal materials joined by welding, adhesion, or by means of a rivet. It may also have a layer such as plated layer on its surface. Exemplary metal materials include iron-based materials (e.g. steel rod or plate and zinc-plated steel plate) and non-iron-based metal materials such as aluminum-based, zinc-based, and magnesium-based materials (e.g. plate, rod, die-cast materials, and cast materials).

The metal material may comprise an iron-based material such as a steel rod or plate since formation of the bismuth-containing layer (hereinafter referred to as the "bismuth coating") is particularly effective in improving throwing power in the electrodeposition for an iron-based material.

The metal material with a bismuth coating of the present invention needs to have the bismuth coating only on at least a part of the surface of the metal material, and it may also have a layer not containing the bismuth (hereinafter also referred to as "Bi"). However, the metal material with a bismuth coating of the present invention preferably has the bismuth coating on the entire surface of the metal material in view of the improved throwing power, corrosion resistance, and coating adhesion. A metal material comprising the metal material (substrate), a layer not containing the bismuth on the surface of the metal material, and the bismuth coating on at least a part of the bismuth-free layer is also within the scope of the present invention.

The metal material with a bismuth coating of the present invention has the bismuth coating on at least a part of its surface, and the bismuth coating may comprise two or more types. For example, the metal material with a bismuth coating of the present invention may be the one having two bismuth coatings each having different bismuth content of the surface layer.

When the metal material has two or more types of bismuth coatings, the coatings may overlap with each other (or the coatings may be disposed one on another). In such a case, however, the bismuth coating not forming the surface layer of the metal material with a bismuth coating of the present invention is believed to only contribute for the improvement of the corrosion resistance and not for the improvement of the throwing power.

In the metal material with a bismuth coating of the present invention, the percentage of the bismuth atoms in the number of atoms (hereinafter also referred to as the "bismuth percentage") in the surface layer of the metal material with a bismuth coating is at least 10%. The metal material with a bismuth coating of the present invention has realized the high throwing power by this bismuth percentage in the surface layer of at least 10%. When the bismuth percentage in the surface layer is less than 10%, the throwing power to the pocket structure, and hence, thickness of the layer formed by the electrodeposition in such part will be reduced, and eventually, the pocket structure will not have sufficient corrosion resistance.

Since the throwing power increases with the increase in the bismuth percentage in the surface layer, the bismuth percentage in the surface layer is preferably at least 15%, and more preferably at least 20%.

As described above, the metal material with a bismuth coating of the present invention preferably has a higher bismuth percentage in the surface layer. Since it is the bismuth atoms in the surface layer that presumably contributes for the improvement in the throwing power in the present invention, the bismuth atoms are preferably located at the surface of the metal material with a bismuth coating of the present invention so that the bismuth atoms are exposed to the exterior. However, the bismuth atoms may also be located in the surface layer other than the surface (namely, in the interior).

In the present invention, "percentage of bismuth atoms in the surface layer of the metal material with a bismuth coating" means percentage (in the number of atoms) of the bismuth atoms in the surface layer in relation to all atoms (including the bismuth atoms) other than hydrogen and helium in the surface layer of the metal material with a bismuth coating. This percentage of the bismuth atoms is determined by measuring wide spectrum of the surface layer of the metal material with a bismuth coating by X-ray electron spectroscopy for chemical analysis (ESCA), and calculating the total number of atoms other than hydrogen and helium and the number of bismuth atoms.

The "surface layer" in the metal material with a bismuth coating of the present invention corresponds to a position of 1.3 nm in terms of Si in depth direction from the surface of the metal material with a bismuth coating of the present invention when analyzed by ESCA. This is because the surface conditions of the film formed by the chemical conversion changes by the substantial oxidation and surface contamination caused by the atmosphere.

Accordingly, the bismuth coating in the metal material with a bismuth coating of the present invention may preferably have a thickness of at least 1.3 nm for facilitating the measurement of the bismuth percentage while the thickness of the bismuth coating is not particularly limited.

In general, ESCA is capable of conducting a qualitative analysis of various elements constituting the surface region from the surface to some depth and also detecting the electronic state of each element, and accordingly, ESCA can be used in analyzing surface condition of a sample.

As described above, when the metal material with a bismuth coating of the present invention has the bismuth coating on its entire surface, (namely, when the entire surface of the metal material is covered by the bismuth coating), the "surface layer" in the metal material with a bismuth coating of the present invention corresponds to a position of 1.3 nm in terms of Si in the ESCA analysis from the surface of the bismuth coating. When the metal material with a bismuth coating of the present invention has the bismuth coating on a part of its surface, and the remaining surface has the metal material exposed or other bismuth-free coating, the "surface layer" in the metal material with a bismuth coating of the present invention corresponds to a position of 1.3 nm in terms of Si in the ESCA analysis from the surface of the bismuth coating or the surface of the metal material left exposed, or the like.

Use of X-ray fluorescence (XRF) enables measurement of atoms present in the region from the surface to the depth of several dozen μm (for example, 20 to 30 μm). The bismuth coating of the present invention (which is, for example, about 20 nm thick), however, is sufficiently thinner than such range, and therefore, use of XRF is preferable in measuring an amount of the elements in the entire coating.

Area coverage of the metal material with a bismuth coating of the present invention by the bismuth-containing layer depends on the coating weight of the bismuth, and the coverage increases with the increase in the bismuth coating weight. Since the corrosion resistance improves with the increase in the bismuth coating weight, the coverage is preferably at least 10%, more preferably at least 30%, and most preferably at least 50%.

The "coverage by the bismuth-containing layer" is not the value calculated from the surface area which has taken surface roughness into consideration, but the value calculated from the surface area converted as a flat surface from the image obtained in the observation of the surface by the SEM, and it corresponds to the ratio of the area of the metal material left exposed to the area where the coating had been formed.

Since visual detection of very minute bismuth crystals in the SEM observation of the surface may be difficult, the coverage of the present invention is not limited by the specific value calculated from the photomicrograph attached to the present invention.

The bismuth coating may contain substances other than the bismuth.

The substance other than the bismuth that constitutes the bismuth coating is not particularly limited. However, Sn is preferably absent in the bismuth coating since the presence of Sn in the bismuth coating may result in the loss of sufficient corrosion resistance.

In one preferred embodiment, the bismuth coating further comprises at least one member selected from the group consisting of Al, Ga, Ge, Se, Y, Sb, and Te.

Total content of the bismuth and the at least one member selected from the group consisting of Al, Ga, Ge, Se, Y, Sb, and Te in the bismuth coating is preferably 20 to 200 $mg/m^2$, and more preferably 40 to 150 $mg/m^2$ in view of improving the corrosion resistance and reducing the cost.

The bismuth in the bismuth coating is present in the form of metal bismuth or a compound such as metal oxide or metal hydroxide, and improves both the corrosion resistance and coating adhesion after the cationic electrodeposition and the throwing power in the electrodeposition.

The bismuth in the bismuth coating is preferably present in the form of at least one member selected from the group consisting of metal, metal oxide, and metal hydroxide.

When the bismuth coating contains at least one member selected from the group consisting of Al, Ga, Ge, Se, Y, Sb, and Te in addition to the bismuth, such additional substances are also preferably present in the form of at least one member selected from the group consisting of metal, metal oxide, and metal hydroxide.

Such bismuth coating can be formed by the method for producing a metal material with a bismuth coating of the present invention as will be described later. When the bismuth coating formed by the method for producing a metal material with a bismuth coating of the present invention is observed by an electron microscope or the like, a metal bismuth-containing layer in the form of islands will be found on the surface of the metal material. Such bismuth coating basically comprises metal bismuth in the form of particles on the surface of the metal materials, and the metal bismuth particles are forming the bismuth-containing layer in the form of islands.

Next, the mechanism for the formation of the bismuth coating by the method for producing a metal material with a bismuth coating of the present invention is described by referring to FIG. 1 in which an iron substrate is used for the metal material. The present invention, however, is not limited to the mechanism as described below.

FIG. 1 is a view explaining the mechanism by which a bismuth coating is formed by the method for producing a metal material with a bismuth coating of the present invention.

In the method for producing a metal material with a bismuth coating of the present invention, the surface-treating solution of the present invention is brought in contact with the iron substrate, and the bismuth ion in the surface-treating solution of the present invention then receives electrons from the Fe in the iron substrate as represented by the reaction scheme:

$$3Fe+2Bi^{3+}\rightarrow 3Fe^{2+}+2Bi,$$

and the metal bismuth is thereby deposited. As shown in FIG. 1, the anode section from which the iron substrate dissolves and the cathode section where the bismuth deposits are polarized, and the anode section is represented as a concave or recess. In its vicinity is formed a layer containing the metal bismuth in the form of particles. As a consequence, the layer containing the metal bismuth is formed on the surface of the iron substrate in the form of islands.

The layer comprising a large number of metal bismuth-containing particulate regions on the surface does not necessarily contain the substance other the metal bismuth as long as it contains the metal bismuth. The inventors are of the opinion that the part corresponding to the nucleus of the particulate region generally contains the metal bismuth, and in view of the effects of the surface contamination, a layer containing bismuth hydroxide (e.g., $Bi(OH)_3$) or bismuth oxide (e.g., $Bi_2O_3$) is formed in the outermost layer.

The metal material with a bismuth coating of the present invention as described above is not particularly limited for its production method, and exemplary production methods include sputtering, PVD, CVD, and other vapor deposition, sol-gel method, electroplating, and chemical conversion.

In an exemplary method, a bismuth coating comprising bismuth or a coating comprising a bismuth oxide (e.g., $Bi_2O_3$) is formed by using bismuth or its oxide for the target, and irradiating this target with an electron beam in an atmosphere at a reduced pressure to thereby deposit the bismuth atoms on the surface of the metal material.

Of the various production methods as described above, the metal material with a bismuth coating of the present invention, however, is most desirably produced by the chemical conversion because the chemical conversion is the method capable of readily producing the metal material with a bismuth coating of the present invention at a reduced cost. In particular, the metal material with a bismuth coating of the present invention is more preferably produced by the method for producing a metal material with a bismuth coating of the present invention as will be described later in view of producing the metal material having excellent corrosion resistance and coating adhesion with high throwing power, with reduced damage to the environment, and with relative easiness.

The metal material with a bismuth coating of the present invention as described above enables formation of an overlying coating with higher uniformity when a coating is deposited on the bismuth coating compared to the conventional case of the metal material treated by zirconium-based chemical conversion (In other words, the metal material with a bismuth coating of the present invention realizes formation of the overlying coating at a higher throwing power). The metal material with a bismuth coating of the present invention also realizes an equivalent or higher throwing power compared to the case of the metal material treated by zinc phosphate. The throwing power is particularly improved when such overlying coating is formed by cationic electrodeposition on the bismuth coating.

In addition, the metal material with a bismuth coating of the present invention can be produced with reduced stress to the environment compared to the metal material treated by chromate treatment or zinc phosphate treatment. The resulting product is also superior in the corrosion resistance and coating adhesion.

The reason why the throwing power is improved in the cationic electrodeposition of the metal material with a bismuth coating of the present invention is yet unclear. However, the estimation of the inventors of the present invention is as described below.

In the cationic electrodeposition, the coating is formed by the electrolysis conducted by using the coating subject (the metal material with a bismuth coating of the present invention) for the cathode. In this cationic electrodeposition, hydrogen ion is reduced at the surface of the coating subject, and this results in the generation of hydrogen gas, and in turn results in the increase of the pH at the surface of the coating subject. The increase in the pH invites the gelation and deposition of the resin component such as laminated epoxy emulsion resin that had been included in the coating composition. The hydrogen gas generation continues during the electrolysis, and as a consequence, gas escape holes are formed in the coating.

The deposited resin has a sufficiently high resistance. Accordingly, as long as the same coating composition is used, the substantial resistance of the coating is determined by the physical configuration of the coating, namely by the size and the number of the holes formed by the escaping hydrogen gas.

When the sites of the hydrogen gas generation are sparsely distributed, the electric current will be focused on such sites and huge gas holes will be formed at such sites, and in this case, the coating resistance will not increase smoothly. On the other hand, when sites of the gas generation are finely distributed, the coating resistance will swiftly increase since the resistance generates at each of the increasing gas holes which is filled by the hydrogen gas. The increased coating resistance results in the swift switching of the current to the part of the pocket structure, and the pocket structure will enjoy sufficient coating thickness. The throwing power is thereby improved.

In general, when an iron-based material with no further treatment is subjected to cathodic electrolysis, generation of hydrogen gas is sparse, and the coating resistance is less likely to be increased, and hence, high throwing power is not expected. Presumably, the reason for such sparse generation of the hydrogen gas is the electrochemical ununiformity of the surface of the iron or steel material, and on such surface, the site of the hydrogen gas generation is not smoothly formed.

In contrast, the metal material with a bismuth coating of the present invention contains at least 10% in number of atoms of bismuth in the surface layer which is subject to the cationic electrodeposition, and therefore, hydrogen gas generation is induced at numerous sites each at a small amount, and this results in the rapid increase in the coating resistance. The throwing power is thereby improved.

In the case when the iron or steel material that had been treated by zinc phosphate is subjected to cathodic electrolysis, hydrogen gas is generated between the zinc phosphate crystals presumably because the zinc phosphate crystal is a semiconductor and less electroconductive, and the coating is constituted from discontinuous assemblies of crystals. Grain size of the zinc phosphate crystals is about 10 μm at the largest, and this inevitably results in the hydrogen gas generation at numerous sites each at a small amount, and hence, high throwing power is realized by the rapid increase in the coating resistance.

In the case of the iron or steel material that had been treated by conventional zirconium-based chemical conversion, the sites of the hydrogen gas generation are even more sparsely formed than the non-treated iron or steel material, and huge gas holes are formed. As a consequence, the coating resistance is not smoothly increased, and this results in the poor throwing power.

Next, exemplary cases of insufficient throwing power in the cationic electrodeposition are presented for the case of a metal material having a pocket structure that has been treated by conventional zirconium-based chemical conversion.

For example, high throwing power can not be realized in the case of a metal material having a pocket structure which has been merely treated by the chemical conversion solution described in Patent Literature 1 or Patent Literature 2. More specifically, Patent Literature 1 describes that content of at least one member selected from the group consisting of zirconium, titanium, and hafnium is preferably 20 ppm at the lowest and 10000 ppm at the highest, and more preferably, 50 ppm at the lowest and 2000 ppm at the highest in terms of the metal. Patent Literature 1 also describes aluminum ion, gallium ion, or indium ion as the metal ion of Group III in the periodic table, and its preferable content is in the range of 1 ppm at the lowest and 5000 ppm at the highest, and a more preferable content of 5 ppm at the lowest and 2000 ppm at the highest. However, a high throwing power is not realized by merely applying the chemical conversion solution within the scope of JP 2004-218073A or Patent Literature 2 to the metal material having a pocket structure.

Although the bismuth coating of the present invention is distributed in patches (in the form of islands), the hydrogen gas generation is induced at numerous sites each at a small amount in the cathodic electrolysis. Although the precise mechanism is yet unknown, the situation of the hydrogen gas generation is believed to be associated, for example, with the degree of hydrogen bonding to the bismuth coating surface.

One characteristic feature of the metal material with a bismuth coating of the present invention is that it has realized excellent corrosion resistance and coating adhesion after the coating without sacrificing the throwing power, which is one of the greatest merits of the cationic electrodeposition.

However, absolute evaluation of the throwing power in the cationic electrodeposition is very difficult.

This is because the throwing power in the cationic electrodeposition is dependent not only on how the electric field is applied, distance between the electrodes, namely, the distance between the counter electrode and the coating subject, temperature of the coating composition, stirring conditions of the coating composition, and structure of the coating subject, but also on the identity of the coating composition such as the type of the resin in the coating composition, amount of the amine group incorporated in the resin, and pH of the coating composition.

Accordingly, in the present invention, the throwing power in the electrodeposition is evaluated by comparison with the zinc phosphate treatment which has been widely adopted as a pretreatment for the cationic electrodeposition and the recently developed zirconium-based chemical conversion by conducing the cationic electrodeposition under the same conditions using the same coating composition. More specifically, the throwing power is evaluated as being "sufficient" when the throwing power is equivalent or superior to the zinc phosphate treatment while the throwing power is evaluated as being "insufficient" when the throwing power is equivalent to the level of the zirconium-based chemical conversion.

Next, the method for producing a metal material with a bismuth coating of the present invention and the surface-treating solution of the present invention are described.

The method for producing a metal material with a bismuth coating of the present invention (hereinafter referred to as "the production method of the present invention") is a method comprising the step of treating a surface of the material with the surface-treating solution of the present invention as described below to form a bismuth-containing layer on at least a part of the metal material surface.

The metal material used in the production method of the present invention is the same as those as described above, and the production method of the present invention is well adapted for use with a metal material having a pocket structure since it realizes a high throwing power even if the metal material was the one having a pocket structure.

Preferably, the metal material is preliminarily cleaned by degreasing, which may be carried out by any suitable method known in the art.

The surface-treating solution of the present invention is a surface-treating solution used for the chemical conversion of the metal material surface as a pretreatment of the subsequent coating, and it contains bismuth and a ligand (L1) for the bismuth.

Bismuth is said to stay in the form of an ion when the pH of the surface-treating solution is up to 2.6. However, when the pH of the surface-treating solution is within such range, the material treated by this solution (i.e., the metal material) will dissolve in the solution in a large amount, and especially when the metal material has a zinc plating or the like. On the other hand, when the surface-treating solution has a pH in excess of 2.6, bismuth ions will be unstable and precipitation will take place, and in such a case, sufficient coating weight is not realized. In view of such a problematic situation, the ligand (L1) has been incorporated in the surface-treating solution of the present invention so that at least a part of the bismuth and the ligand (L1) may form a complex comprising the bismuth ion and the ligand. Formation of the complex results in the stabilization of the bismuth ion, and precipitation of the bismuth is suppressed, even if the pH is in excess of 2.6 and formation of a coating having a sufficient coating weight is thereby facilitated.

The source of the bismuth is not particularly limited, and exemplary sources include bismuth nitrate, bismuth sulfate, bismuth acetate, bismuth trifluoride, bismuth vanadate, and bismuth hydroxide, which may be used alone or in combination of two or more.

The surface-treating solution of the present invention may be produced so that the solution as produced has the solid concentration of the level at the time of its actual use (namely, at the time of the surface treatment of the metal material). However, in view of the ease of inventory management and distribution of the solution, the solution may have a concentration higher than the concentration at the time of its actual use and the solution may be diluted or dissolved with a solvent such as water just before its use.

The surface-treating solution of the present invention having a solid concentration higher than the solid concentration at the time of its use is particularly referred to as "the composition of the present invention". Such composition of the present invention is also within the scope of the surface-treating solution of the present invention.

Content of the bismuth atom in the composition and surface-treating solution of the present invention is not particularly limited. The weight concentration (A), namely percentage of bismuth atoms in the composition of the present invention is preferably 50 to 5000 ppm, more preferably 100 to 2000 ppm, and most preferably 200 to 1000 ppm. Productivity will be insufficient when the weight concentration is too low, while excessive weight concentration is uneconomical since the merit of increasing the concentration of the solution is saturated while the coating obtained by the chemical conversion has satisfactory properties.

The weight concentration (a) (namely, content) of bismuth atoms in the surface-treating solution of the present invention at the time of its use in the surface treatment is preferably 5 to 1000 ppm, and more preferably 10 to 500 ppm. When the weight concentration is excessively low, a longer time is required to raise the percentage of the bismuth atom in the bismuth surface layer to the level of 10 at %, and this results in the reduced productivity. On the other hand, the effect realized by the bismuth saturates at a certain level, and excessive bismuth concentration is merely uneconomical.

When the surface-treating solution has a pH of up to 2.6, bismuth can stay in the state of ions in the absence of the ligand. However, at a pH in the range of 3 to less than 10.5, bismuth is present in the state of a hydroxide ion or hydroxide, and the effective concentration of the bismuth component that deposit on the surface of the metal material will be reduced. Accordingly, the composition and the surface-treating solution of the present invention have incorporated therein a ligand for the bismuth to thereby facilitate a more efficient formation of the bismuth chemical conversion film from various components constituting the composition or the surface-treating solution.

The ligand (L1) is not particularly limited, and examples include carboxylic acids such as formic acid, acetic acid, acrylic acid, and polyacrylic acid; aminocarboxylic acids such as ethylenediamine tetraacetic acid, 2-hydroxyethyl ethylenediamine triacetic acid, trans-1,2-cyclohexanediamine tetraacetic acid, diethylenetriamine pentaacetic acid, ethyleneglycol bis(2-aminoethyl ether)tetraacetic acid, nitrilotriacetic acid, and iminodiacetic acid; and aminopolycarboxylic acids; which may be used alone or in combination of two or more.

Preferably, the ligand (L1) is an aminopolycarboxylic acid and/or a carboxylic acid, and the solution preferably contains at least one ligand which has a stability for bismuth higher than the stability for the ion of the metal constituting the metal material. The reason why it is preferable to incorporate at least one such ligand which has a stability for bismuth higher than the stability for the ion of the metal constituting the metal material is described below.

Generally, it is quite important to stably maintain the metal ion to be deposited in the chemical conversion (bismuth ion in the present invention) in the state of an ion (pseudo ion) since the state of the metal ion affects the easiness of the chemical conversion. Accordingly, a ligand which is capable of accomplishing the ionization in a wide range of pH is added in the present invention.

On the other hand, the metal ions of the substrate dissolve by the chemical reaction between the substrate (the metal material) and the surface-treating solution. When the dissolved metal ion preferentially coordinates with the ligand that is forming a complex with the metal ion to be deposited, the metal ion to be deposited will be precipitated as a hydroxide or oxide since it can no longer exist in a stable manner. This hydroxide and oxide are incapable of depositing on the surface of the substrate and the addition of the ligand will be meaningless.

Accordingly, when the stability of the ligand for the metal to be deposited is higher than the stability of the ligand for the dissolved metal, the metal to be deposited can stably exist in the surface-treating solution and, as a consequence, the desired film can be obtained both economically and efficiently.

In one preferred embodiment of the surface-treating solution of the present invention, the surface-treating solution contains an aminopolycarboxylic acid and/or a carboxylic acid as the ligand (L1), and this ligand (L1) has a stability for bismuth higher than the stability for the ion of the metal constituting the metal material, and the solution further comprises a ligand (L2) which has a stability for the ion of the metal constituting the metal material higher than the stability for bismuth. As described above for the ligand (L1), the simultaneous presence of a ligand having a relatively high stability for the ion of the metal constituting the substrate results in the specialized, namely, preferential coordination of such ligand to the ion of the metal constituting the substrate, and as a consequence, the ligand coordinated to the metal ion to be deposited can fully fulfill its role.

The ligand (L2) is either a ligand having a low stability for the bismuth or a ligand which does not coordinate with bismuth, but which has a stability for the ion of the metal constituting the metal material higher than the stability for bismuth. The ligand (L2) is not particularly limited, and examples of the ligand (L2) also include those other than the compounds mentioned for the ligand (L1), and the ligand (L2) may be an organic compound or an inorganic compound adequately selected depending on the type of the metal material used or the type of the ligand (L1). Also, two or more types of the ligand (L2) may be used at once.

The concentration of the ligand (L1) in the surface-treating solution of the present invention may be adequately adjusted depending on the desired pH and/or the bismuth concentration of the surface-treating solution. For example, the weight concentration of the ligand (L1) at the time when the solution is used for the surface treatment is preferably 5 to 25000 ppm, and the concentration may be adjusted to any value depending on the pH of the solution used in consideration of the coordination number of the bismuth. Use of an excessively high concentration has no adverse effects while such excessively high concentration may be economically disadvantageous. The concentration is preferably 10 to 10000 ppm, and more preferably 200 to 3000 ppm in view of maintaining the stability of the bismuth. When the concentration of the ligand (L1) is within such range, the solution will have stronger effect of stabilizing the bismuth ion and the desired metal material with a bismuth coating will be produced.

Concentration of the ligand (L2) in the surface-treating solution of the present invention is not particularly limited. However, the concentration at the time when the solution is used for the surface treatment is preferably 10 to 15000 ppm, and more preferably 200 to 5000 ppm.

The composition or the surface-treating solution of the present invention may further contain one or more members selected from the group consisting of Al, Ga, Ge, Se, Y, Sb, and Te. These atoms are not particularly limited for their state, and they may be present in the form of ions or in the form of a complex with a ligand.

The sources of these atoms are not particularly limited, and exemplary sources include chlorides, hydroxides, sulfate compounds, nitrate compounds, fluorides, and organic acid compounds, which may be used alone or in a combination of two or more.

When the composition or the surface-treating solution of the present invention contains at least one member selected from the group consisting of Al, Ga, Ge, Se, Y, Sb, and Te, the total content (weight concentration) of the atom in the composition or the surface-treating solution of the present invention is not particularly limited.

The total content, or the weight concentration (B) of the at least one member selected from the group consisting of Al, Ga, Ge, Se, Y, Sb, and Te in the composition of the present invention is preferably 100 to 2000 ppm, and more preferably 200 to 1000 ppm. When the weight concentration is excessively low, the amount of the composition required for replenishing the effective components lost in the treatment will be enlarged. On the other hand, an excessive content may adversely affect on the coating.

The total content, or the weight concentration (b) of the at least one member selected from the group consisting of Al, Ga, Ge, Se, Y, Sb, and Te in the surface-treating solution of the present invention at the time of its use, is preferably 30 to 1000 ppm, and more preferably 50 to 200 ppm in view of forming a bismuth coating having an excellent corrosion resistance in a relatively easy and inexpensive manner.

The composition or the surface-treating solution of the present invention may further contain fluorine. Fluorine is one of the elements required for the etching of the metal material.

The source of the fluorine is not particularly limited, and exemplary sources include hydrofluoric acid, ammonium fluoride, ammonium hydrogen fluoride, sodium fluoride, indium fluoride, zirconium hydrofluoric acid, aluminum fluoride, lithium fluoride, hydrofluorosilicic acid, ammonium hydrofluorosilicate, and magnesium hydrofluorosilicate, which may be used alone or in combination of two or more.

The content of the fluorine in the composition or the surface-treating solution of the present invention is not particularly limited. The weight concentration of the fluorine ion in the composition of the present invention, however, is preferably 300 to 10000 ppm, more preferably 500 to 5000 ppm, and most preferably 1000 to 3000 ppm.

The weight concentration of the fluorine ion in the surface-treating solution of the present invention at the time of its use is preferably 10 to 5000 ppm, more preferably 10 to 2000 ppm, and most preferably 10 to 1000 ppm.

The surface-treating solution of the present invention is not particularly limited for its pH. The pH, however, is preferably in the range of at least 2 and less than 10.5. More preferably, the pH is in the range of 3.0 to 5.0 in view of reducing the excessive etching of the metal material.

When adjustment of the pH of the surface-treating solution of the present invention is required, the adjustment may be accomplished by using any adequate agent. Exemplary agents include acids such as hydrochloric acid, sulfuric acid, nitric acid, hydrofluoric acid, boric acid, and an organic acid, and alkaline agents such as lithium hydroxide, potassium hydroxide, sodium hydroxide, calcium hydroxide, magnesium hydroxide, alkali metal salt, ammonia, ammonium salt, and an amine, which may be used alone or in combination of two or more.

Preferably, the composition and/or the surface-treating solution of the present invention further comprises a brightener. Incorporation of the brightener drastically improves adhesion between the metal material and the bismuth coating. This leads to the prevention of the coating components from being removed off the metal material during the harsh spray rinsing after the chemical conversion, and hence economical advantage. However, even if a surface-treating solution containing no brightener component were used, removal of the coating components can be prevented by selecting adequate procedure in the rinsing, and even if such removal occurred, adhesion of the coating, corrosion resistance, and the throwing power of the coating are still sufficient despite some economical disadvantage.

The inventors of the present invention has found that, incorporation of the brightener in the composition and/or the surface-treating solution of the present invention enables control of the orientation of the bismuth depositing on the metal material. As a consequence, the state of the bismuth deposition on the metal material is changed into a more compact state with increased phase to phase adhesion. Accordingly, the brightener is also referred in the present invention as a "a substance for controlling crystal orientation".

The composition and/or the surface-treating solution of the present invention also exhibits sufficient throwing power in the coating and realizes improved corrosion resistance and coating adhesion in the absence of such brightener. However, when the composition and/or the surface-treating solution contains a brightener and the bismuth coating weight is equivalent, the treated metal material will exhibit superior corrosion resistance.

The effect that the brightener has on the deposition of the bismuth on the metal material is not fully understood. However, our estimation is as described below, while the present invention is not at all limited by this estimation.

Presumably, during the deposition of the bismuth on the metal material, the brightener is adsorbed onto the metal material, and suppresses dissolution of the metal material which is the anode, and this in turn reduces the electric current of the cathode and the speed of the bismuth deposition is slightly reduced. At the same time, the brightener is preferentially adsorbed on the surface of the metal material where the deposited bismuth crystals are growing, and such adsorption suppresses the crystal growth on that surface, and this facilitates bismuth deposition at other locations.

The brightener may be a known brightener used in the art, namely, a compound added to the plating bath or the like for the purpose of brightening the plated coating, and such known brightener may be used with no particular limitation.

Examples include sodium 1,3,6-naphthalenetrisulfonate, sodium saccharinate, p-toluenesulfonamide, polyethylene glycol, β-naphthol, m-chlorobenzaldehyde, mesityl oxide, acrylic acid, (o-, m-, or p-)toluidine, gelatin, N-(3-hydroxybutylidene)-p-sulfanilic acid, β-naphthol-6-sulfonic acid, p-nitrobenzaldehyde, isophorone, methacrylic acid, (o- or p-)aminoaniline, polypeptone, N-butylidene sulfanilic acid, β-naphthalene sulfonic acid, p-hydroxybenzaldehyde, diacetyl, ethacrynic acid, aniline, N-cinnamoylidene sulfanilic acid, (o- or p-)methoxybenzaldehyde, hexanedione-3,4 ethyl acrylate, (o- or p-)chloroaniline, 2,4-diamino-6-(2'-methylimidazolyl (1'))ethyl-1,3,5-triazine, vanillin, acetyl acetone, methyl methacrylate, (2,5- or 3,4-)chloromethylaniline, 2,4-diamino-6-(2'-ethyl-4-methyl imidazolyl (1'))ethyl-1,3,5-triazine, (2,4- or 2,6-)dichlorobenzaldehyde, 3-chlorobenzylidene acetone, butyl methacrylate, N-monomethylaniline, 2,4-diamino-6-(2'-undecyl imidazolyl(1'))ethyl-1,3,5-triazine, (o- or p-)chlorobenzaldehyde, sub. pyridylidene acetone, crotonic acid, 4,4'-diaminodiphenylmethane, phenyl salicylate, 1-naphthaldehyde, sub.fulfuryldine acetone, propylene-1,3-dicarboxylic acid, N-phenyl-(α- or β-)naphthylamine, benzothiazole, 2-naphthaldehyde, sub. thenylidene acetone, cinnamic acid, methyl benzotriazole, 2-methyl benzothiazole, 2(4)-hydroxy-1-naphthaldehyde, 4-(1-naphthyl)-3-buten-2-ol, 1,2,3-triazine, 2-mercaptobenzothiazol, 2(4)-chloro-1-naphthaldehyde, 4-(2-furyl)-3-buten-2-one, 1,2,4-triazine, 2-(methylmercapto) benzothiazole, 2(3)-thiophenecarboxyaldehyde, 4-(2-thiophenyl)-3-buten-2-ol, 1,3,5-triazine, 2-aminobenzothiazole, 2(3)-furaldehyde, curcumin, 1,2,3-benzotriazine, 2-amino-6-methoxybenzothiazole, 3-indole carboxyaldehyde, benzylidene acetylacetone, imidazole, 2-methyl-5-chlorobenzothiazole, salicylaldehyde, benzal acetone, 2-vinylpyridine, 2-hydroxybenzothiazole, o-phthalaldehyde, acetophenone, indole, 2-amino-6-methyl benzothiazole, formaldehyde, (2,4- or 3,4-)dichloro acetophenone, quinoline, 2-chlorobenzothiazole, acetaldehyde, benzylidene acetophenone, monoethanolamine, 2,5-dimethyl benzothiazole, paraldehyde, 2-cinnamylthiophene, 6-nitro-2-mercaptobenzothiazol, butyraldehyde, 2-(ω-benzoyl) vinyl furan, polyvinyl alcohol, 5-hydroxy-2-methylbenzothiazole, isobutyraldehyde, vinyl phenyl ketone, catechol, 2-benzothiazole thioacetic acid, propionaldehyde, hydroquinone, n-valeraldehyde, resorcin, acrolein, polyethylenimin, crotonaldehyde, disodium ethylenediaminetetraacetate, glyoxal, polyvinylpyrrolidone, aldol, succindialdehyde, capronaldehyde, isovaleraldehyde, allyl aldehyde, glutaraldehyde, 1-benzylidene-7-heptanal, 2,4-hexadienal, cinnamaldehyde, and benzyl crotonaldehyde, which may be used alone or in a combination of two or more.

The brightener is preferably an organic compound having at least one member selected from the group consisting of aromatic ring, sulfone group, formyl group, carboxy group, and amino group, and more preferably at least one member selected from the group consisting of sodium naphthalenetrisulfonate, sodium naphthalenesulfonate, vanillin, and sodium saccharinate. Also preferred are salts of sodium naphthalenetrisulfonate, sodium naphthalenesulfonate, vanillin, or sodium saccharinate with an acid or another cation.

The content of the brightener in the surface-treating solution of the present invention is not particularly limited. However, the weight concentration of the brightener in the surface-treating solution of the present invention when it used for the surface treatment is preferably 10 to 10000 ppm, and more preferably 100 to 5000 ppm. When the content of the brightener is within such range, adhesion of the bismuth coating to the metal material will be sufficient, and excessive addition of the brightener does not cause any problem.

The method used for producing the surface-treating solution of the present invention is not particularly limited, and the surface-treating solution of the present invention can be produced, for example, by mixing the bismuth-containing substance which is the source of the bismuth, the ligand for the bismuth, and the optional arbitrary components such as the brightener and the solvent in an agitator or the like.

As in the case of zirconium-based chemical conversion, the surface-treating solution of the present invention is capable of forming the necessary amount of chemical conversion film on various metal materials having a pocket structure with reduced damage to the environment, and imparting the metal material with sufficient corrosion resistance and coating adhesion, and in addition, the surface-treating solution of the present invention is capable of realizing a high throwing power in cationic electrodeposition.

In the production method of the present invention, the surface-treating solution of the present invention as described above is brought in contact with the metal material for the surface treatment to thereby form a bismuth-containing layer (bismuth coating) on at least a part of the surface of the metal material.

When the surface-treating solution of the present invention contacts the metal material, the bismuth coating deposits on the surface of the metal material.

The bismuth in the bismuth coating formed by the production method of the present invention is believed to be in the form of any one of a metal, a hydroxide, an oxide, or a hydrate.

The method used to bring the surface-treating solution of the present invention in contact with the metal material is not particularly limited, and any method used in normal chemical conversion may be employed. Exemplary methods include spraying, dipping, flowing, and electrolysis.

Among these, the preferred is dipping since this method is capable of bringing all parts of an article with complicated structure with the solution, and therefore capable of relatively easily forming the bismuth coating on the entire surface of the metal material.

At the time of the surface treatment, the surface-treating solution of the present invention is preferably at a temperature of 25 to 55° C., more preferably 30 to 50° C., and most preferably 35 to 45° C. Use of the solution at the temperature in such range does not require use of excessive heat energy, and the treatment can be accomplished with less environmental harm and in an economical way.

The time of the surface treatment is not particularly limited. The surface treatment, however, is preferably conducted for 2 to 600 seconds, more preferably 30 to 300 seconds, and most preferably 30 to 120 seconds. The time used for the surface treatment is deeply related to the productivity, and use of a shorter time is desirable. However, excessively short chemical conversion time results in the insufficient bismuth coating weight in the inside of the pocket structure since liquid replacement in the interior of the pocket structure will be slower than the exterior of the pocket structure, and the chemical conversion reaction starts later in the interior region. Accordingly, a certain time will be necessary to realize the bismuth coating weight necessary for realizing the desired corrosion resistance both in the exterior and in the interior of the pocket structure. There is no upper limit for the time of the surface treatment when the productivity is not considered.

After such surface treatment, the metal material is preferably rinsed. Washing with deionized water is also preferable, and rinsing with water and subsequently with deionized water is more preferable. The method used for rinsing with water is not particularly limited, and any known method such as dipping and spraying may be employed. The last rinsing with water is preferably conducted by using deionized water, and preferably by spraying.

After rinsing with water, the metal material may be dried or left without drying.

The production method of the present invention is capable of producing a metal material with a bismuth coating of the present invention with reduced damage to the environment which has sufficient corrosion resistance and coating adhesion, and this production method also exhibits high throwing power in the coating (and in particular, in the cationic electrodeposition).

Next, the metal material having a coating formed by cationic electrodeposition and the method for producing such material of the present invention are described.

The method used for producing the metal material having a coating formed by cationic electrodeposition of the present invention is a method wherein a coating is formed on the surface of the metal material having the bismuth coating formed by the method for producing a metal material with a bismuth coating of the present invention to thereby produce the metal material having a coating formed by cationic electrodeposition.

The method used for the cationic electrodeposition is not particularly limited, and a suitable method known in the art may be employed.

In an exemplary method, a coating composition for cationic electrodeposition comprising an amine adduct epoxy resin as the coating and a blocked polyisocyanate curing agent as the curing component is used, and the metal material with a bismuth coating of the present invention is dipped in this coating composition. The metal material with a bismuth coating of the present invention may or may not be dried before the dipping.

The coating composition is maintained at a temperature of about 26 to 30° C. with optional stirring of the coating with a stirrer, and voltage is applied to the metal material with a bismuth coating of the present invention, for example, by a rectifier.

The electrolysis may be conducted at normal conditions, for example, by applying a linearly increasing voltage of 0 V to 200 V in the first 30 seconds in the direction to the cathode, and then maintaining the voltage at 200 V for 150 seconds.

The production method of the metal material having a coating formed by cationic electrodeposition of the present invention preferably further comprises the step of rinsing with water of the metal material with a bismuth coating of the present invention having the coating formed on the surface by cationic electrodeposition. The method used for the rinsing with water may be the same as the one described above.

Preferably, the method used for producing the metal material having a coating formed by cationic electrodeposition of the present invention further comprises the step of baking the formed coating, and this baking step may be conducted after the electrodeposition or after the step of rinsing with water when such step is included. More specifically, the baking is accomplished by heating the metal material having the coating formed by subjecting the surface of the metal material with a bismuth coating of the present invention to the cationic electrodeposition. The baking, for example, may be conducted at 170° C. for 20 minutes to thereby finish the coating.

The coating of the metal material produced by the method for producing the metal material having a coating formed by cationic electrodeposition of the present invention may preferably have an average thickness of 1 to 50 μm, more preferably 5 to 40 μm, and most preferably 7 to 25 μm.

The thinnest part of the coating may preferably have a thickness of at least 7 μm since sufficient corrosion resistance is not realized when the thinnest part is excessively thin.

The thickest part may preferably have a thickness of not more than 40 μm, and more preferably not more than 25 μm. Excessive maximum thickness results in the increase of the surface roughness of the coating, which is less advantageous both in view of appearance and economy.

In the present invention, the thickness of the coating is measured by using an electromagnetic coating thickness meter or an eddy current coating thickness meter. When the coating is formed on a magnetic metal material such as iron or iron alloy, the thickness is measured by using an electromagnetic coating thickness meter, and when the coating is formed on a non-magnetic metal material such as aluminum or aluminum alloy, the thickness is measured by using an eddy current coating thickness meter. More specifically, the thickness is determined by measuring the thickness at several locations, and calculating the average.

The metal material having a coating formed by cationic electrodeposition of the present invention as described above has a uniform coating formed on the surface, and it also enjoys excellent corrosion resistance and coating adhesion. In addition, this metal material can be produced with reduced damage to the environment.

The method used for producing the metal material having a coating formed by cationic electrodeposition of the present invention is capable of producing a metal material having a coating formed by cationic electrodeposition with reduced damage to the environment. The metal material product has a uniform coating formed on the surface, and exhibits corrosion resistance and coating adhesion.

EXAMPLES

Next, the present invention is described in detail by referring to the Examples, which by no means limit the scope of the present invention.

<Metal Plate>

The following metal materials were used (all manufactured by PALTEK Corporation).

Cold rolled steel plate: SPCC (JIS3141), 70×150×0.8 mm (hereinafter abbreviated as "SPC")

Galvanized steel plate: SGCC F06 MO (JISG3302), 70×150×0.8 mm (hereinafter abbreviated as "GA")

Aluminum alloy plate: A5052P (JIS4000), 70×150×1.0 mm (hereinafter abbreviated as "AL")

<Formation of Bismuth Coating>

Surface of each metal plate was degreased to remove anticorrosive oil. "FC-E2001" manufactured by Nihon Parkerizing Co., Ltd. was used for the degreaser, and it was used by heating to 40° C. and spraying for 120 seconds. After the degreasing, the metal surface was rinsed by spraying the water for 30 seconds.

The metal surface was then treated with the surface-treating solution described in any of the following Examples and Comparative Examples to form a bismuth coating on the entire surface of the metal plate.

The resulting metal material with a bismuth coating was used for evaluation of corrosion resistance, coating adhesion, throwing power, and sludge generation by the procedure as described below. Only in Example 32 and Comparative Example 3, the coating was formed by solvent coating in place of electrodeposition.

<Cationic Electrodeposition for Evaluation of Coatability>

Cathodic electrolysis was conducted by using the resulting metal material with a bismuth coating for the cathode and "GT-10HT" manufactured by Kansai Paint Co., Ltd. for the electrodeposition paint, and at a constant voltage for 180 seconds to deposit the coating on the entire surface of the metal plate. The metal plate was then rinsed, and baked at 170° C. for 20 minutes to finish the coating and produce the metal plated having an electrodeposited coating used for the sample. The conditions were adjusted to form the coating having a thickness of 20 μm.

The electrodeposition paint used was a cationic electrodeposition paint comprising the amine adduct epoxy resin as described above and a blocked polyisocyanate curing agent for the curing component.

<Corrosion Resistance Test, Procedure and Evaluation]

Salt spray test (JIS-Z2371-2000) was conducted after forming cross cuts on the sample, and a single side bulging width was evaluated after 1000 hours. In general, in the case of a cold rolled steel plate, the corrosion resistance is evaluated "good" when the single side bulging width was up to 3 mm and "excellent" when the single side bulging width was up to 2 mm. The corrosion resistance is evaluated "good" when the single side bulging width was up to 3 mm in the case of a galvanized steel plate, and up to 2 mm in the case of an aluminum alloy.

However, the single side bulging width of the cross cuts was evaluated after 72 hours in the salt spray test of Example 32 and Comparative Example 3. The results are shown in Table 1.

<Coating Adhesion Test (Secondary Adhesion Test; Salt Dip Test (SDT))>

Two parallel cuts reaching to the matrix were made in the sample in the axial direction, and the sample was dipped in an aqueous solution of NaCl (5% by weight) at 50° C. for 480 hours (20 days). After rinsing with water and air drying, an adhesive tape "L pack LP-24" (manufactured by NICHIBAN Co., Ltd.) was applied along the cuts and the adhesive tape was manually peeled at once. The maximum width of the coating that was attached to the peeled adhesive tape was measured.

In general, in the case of a cold rolled steel plate, the coating adhesion is evaluated good when the maximum width of the coating attached to the peeled adhesive tape is up to 3 mm and excellent when the maximum width is up to 2 mm. The coating adhesion is evaluated good when the maximum width is up to 3 mm in the case of a galvanized steel plate, and up to 2 mm in the case of an aluminum alloy.

Example 32 and Comparative Example 3 were excluded from the test. The results are shown in Table 1.

<Throwing Power Test, Procedure and Evaluation>

Figure 2A:
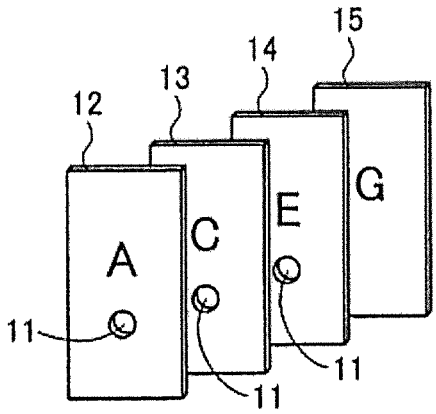
FIG. 2A is a schematic view showing the metal plates used in the throwing power test.
Figure 2B:
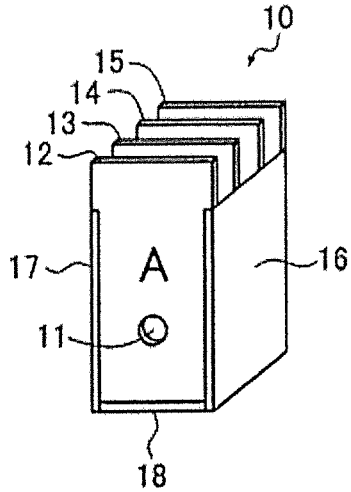
FIG. 2B is a perspective view showing the four plate box used in the throwing power test.
Figure 2C:
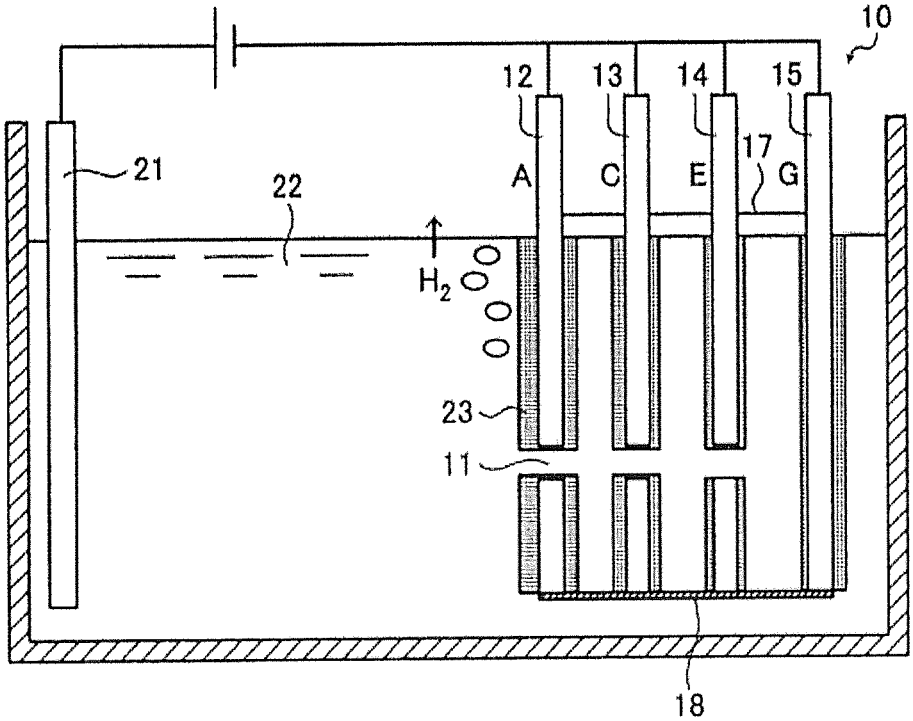
FIG. 2C is a view for explaining the evaluation of the throwing power.

Next, test procedure and evaluation criteria of the throwing power test are explained by referring to FIGS. 2A to 2C.

FIG. 2A is a schematic view showing the metal plates used in the throwing power test, FIG. 2B is a perspective view showing the four-plate box used in the throwing power test, and FIG. 2C is a view for explaining the evaluation of the throwing power.

First, 4 metal plates 12, 13, 14, and 15 of the same type were provided as shown in FIG. 2A. A circular hole 11 having a diameter of 8 mm was formed in each of three metal plates 12, 13, and 14 of the 4 metal plates. The hole 10 was formed at the center of the short side direction (at the same distance from both long sides of the rectangle), and in the longitudinal direction, at 50 mm from one short side of the rectangle (so that the minimum distance between the center of the hole and one short side of the rectangle is 50 mm) and at 100 mm from the other short side of the rectangle.

Next, as showing FIG. 2B, 2 polyvinyl chloride plates 16 and 17 were respectively adhered by an adhesive tape (not shown) to the long sides of each of the 4 metal plates. A vinyl chloride plate 18 was also adhered by an adhesive tape so that the plate was in contact with one short side of each of all four metal plates, and to thereby form the four-plate box 10. This four-plate box 10 corresponds to "the metal material having a pocket structure" of the present invention. In FIG. 2B, the 4 metal plates 12, 13, 14, and 15 are arranged in parallel, and the distance between the plates is 20 mm for all plates. The metal plates 12, 13, and 14 each has a hole 11, and the metal plate 15 does not have a hole. The front side of the metal plates 12, 13, 14, and 15 in FIG. 2B were designated surface A, surface C, surface E, and surface G, respectively.

Next, the four-plate box 10 and the counter electrode 21 were arranged as shown in FIG. 2C. FIG. 2C is a cross sectional view at the center of the short side of the metal plate. More specifically, the four-plate box was arranged so that the metal plate 12 having the hole 11 formed therein was on the side near the counter electrode 21. Wiring was conducted to short-circuit all of the 4 metal plates.

A stainless steel plate (SUS304) of 70×150×0.5 mm having one surface (the surface not facing the four-plate box) insulated with an insulating tape was used for the counter electrode 21.

Paint 22 ("GT-10HT" manufactured by Kansai Paint Co., Ltd.) was filled until the metal plates 12, 13, 14, and 15 and the counter electrode 21 were dipped to the depth of 90 mm. The paint was maintained at a temperature of 28° C., and the paint was stirred with a stirrer (not shown).

Under the conditions as described above, a coating 23 was deposited on the surface of the metal plates 12, 13, 14, and 15 of the four-plate box 10 by cathode electrolysis using the counter electrode 21 for the anode.

More specifically, the electrolysis was conducted by conducting the cathodic electrolysis using a rectifier at a predetermined voltage for 180 seconds. The voltage was adjusted so that a thickness of the coating on surface A of the four-plate box 10 would be 20 μm. After the electrolysis, each metal plate was rinsed, and baked at 170° C. for 20 minutes to form the coating.

The thickness of the coating formed on surface G of the metal plate 15 was measured by an electromagnetic coating thickness meter (when the metal plate was SPC or GA) or an eddy current coating thickness meter (when the metal plate was AL). Average of coating thicknesses measured at 10 randomly selected locations was used for the thickness of the coating on surface G.

The thickness of the coating on surface G is preferably at least 7 μm. The results are shown in Table 1.

<Observation of Sludge>

After treating the cold rolled steel plate at 1 $m^2$/1 L in the Examples and Comparative Examples, the surface-treating solution was allowed to stand at room temperature for 30 days. Turbidity (sludge generation) of the solution was visually examined to evaluate the environmental suitability by the following criteria: The results are shown in Table 1.

A: transparent

B: slight turbidity

C: significant turbidity

D: precipitation (sludge formation)

<Quantitative Determination of Bismuth in the Bismuth Coating>

Amount of bismuth in the bismuth coating before the formation of the coating by electrodeposition was measured by X-ray fluorescence (XRF) spectrometer, "ZSX Primus II" manufactured by RIGAKU Corporation. The results are shown in Table 1.

<Measurement of Bismuth Concentration in the Bismuth Coating Surface Layer>

Wide spectrum of the surface layer was measured by X-ray electron spectroscopy for chemical analysis (ESCA) using "ESCA-850M" manufactured by SHIMAZU CORPORATION) to determine the number of atoms for each type of the atoms, and the bismuth content in the surface layer was thereby calculated. Narrow spectrum of the bismuth and O was also analyzed to examine the state of the coating. The results are shown in Table 1.

Example 1

Bismuth nitrate corresponding to the bismuth concentration of 200 ppm and hydrofluoric acid corresponding to the concentration of 200 ppm were dissolved in water. To this solution, 840 ppm of HEDTA was added and the mixture was stirred until it became transparent. The pH of the solution was adjusted to 3.5 with ammonia, and after adjusting the temperature to 37° C., a plurality of SPC metal plates were dipped in the solution for 180 seconds. After removing the metal plates from the solution, they were rinsed and dried at room temperature to obtain the metal plates with a bismuth coating. The bismuth was present generally as metal bismuth, and the coating weight was 120 mg/$m^2$. Percentage of bismuth atoms in the surface layer was 97%.

The resulting samples were used in the evaluation of the corrosion resistance, the coating adhesion, and the throwing power. The corrosion resistance; 0.8 mm, the coating adhesion; 0.8 mm, and the throwing power; 9.8 μm. The result of the sludge observation was "transparent", and the environmental suitability was "A".

Example 2

The procedure of Example 1 was repeated except that the bismuth concentration was 100 ppm to prepare a metal material with a bismuth coating.

The bismuth was present generally as metal bismuth, and the coating weight was 60 mg/$m^2$. Percentage of bismuth atoms in the surface layer was 42%. The resulting samples were used in the evaluation of the corrosion resistance, the coating adhesion, and the throwing power. The corrosion resistance; 1.2 mm, the coating adhesion; 0.8 mm, and the throwing power; 9.0 μm. The result of the sludge observation was "transparent", and the environmental suitability was "A".

Example 3

The procedure of Example 1 was repeated except that the bismuth concentration was 1000 ppm and HEDTA concentration was 1400 ppm to prepare a metal material with a bismuth coating.

The bismuth was present generally as metal bismuth, and the coating weight was 500 mg/$m^2$. Percentage of bismuth atoms in the surface layer was 95%. The resulting samples were used in the evaluation of the corrosion resistance, the coating adhesion, and the throwing power. The corrosion resistance; 1.2 mm, the coating adhesion; 0.8 mm, and the throwing power; 11.0 μm. The result of the sludge observation was "transparent", and the environmental suitability was "A".

Example 4

The procedure of Example 1 was repeated except that the chemical conversion was conducted for 60 seconds to prepare a metal material with a bismuth coating.

The bismuth was present generally as metal bismuth, and the coating weight was 40 mg/m$^2$. Percentage of bismuth atoms in the surface layer was 38%. The resulting samples were used in the evaluation of the corrosion resistance, the coating adhesion, and the throwing power. The corrosion resistance; 1.4 mm, the coating adhesion; 1.6 mm, and the throwing power; 8.8 μm. The result of the sludge observation was "transparent", and the environmental suitability was "A".

Example 5

The procedure of Example 1 was repeated except that the chemical conversion was conducted for 120 seconds to prepare a metal material with a bismuth coating.

The bismuth was present generally as metal bismuth, and the coating weight was 80 mg/m$^2$. Percentage of bismuth atoms in the surface layer was 70%. The resulting samples were used in the evaluation of the corrosion resistance, the coating adhesion, and the throwing power. The corrosion resistance; 1.2 mm, the coating adhesion; 1.3 mm, and the throwing power; 9.0 μm. The result of the sludge observation was "transparent", and the environmental suitability was "A".

Example 6

The procedure of Example 1 was repeated except that the chemical conversion was conducted for 300 seconds to prepare a metal material with a bismuth coating.

The bismuth was present generally as metal bismuth, and the coating weight was 450 mg/m$^2$. Percentage of bismuth atoms in the surface layer was 95%. The resulting samples were used in the evaluation of the corrosion resistance, the coating adhesion, and the throwing power. The corrosion resistance; 1.0 mm, the coating adhesion; 0.8 mm, and the throwing power; 10.5 μm. The result of the sludge observation was "transparent", and the environmental suitability was "A".

Example 7

The procedure of Example 1 was repeated except that the pH of the surface-treating solution was 2.0 to prepare a metal material with a bismuth coating.

The bismuth was present generally as metal bismuth, and the coating weight was 80 mg/m$^2$. Percentage of bismuth atoms in the surface layer was 60%. The resulting samples were used in the evaluation of the corrosion resistance, the coating adhesion, and the throwing power. The corrosion resistance; 1.2 mm, the coating adhesion; 1.4 mm, and the throwing power; 8.5 μm. The result of the sludge observation was "transparent", and the environmental suitability was "A".

Example 8

The procedure of Example 1 was repeated except that the pH of the surface-treating solution was 4.0 to prepare a metal material with a bismuth coating.

The bismuth was present generally as metal bismuth, and the coating weight was 100 mg/m$^2$. Percentage of bismuth atoms in the surface layer was 85%. The resulting samples were used in the evaluation of the corrosion resistance, the coating adhesion, and the throwing power. The corrosion resistance; 1.0 mm, the coating adhesion; 1.1 mm, and the throwing power; 9.0 μm. The result of the sludge observation was "transparent", and the environmental suitability was "A".

Example 9

The procedure of Example 1 was repeated except that the pH of the surface-treating solution was 7.0 to prepare a metal material with a bismuth coating.

The bismuth was present generally as metal bismuth, and the coating weight was 40 mg/m$^2$. Percentage of bismuth atoms in the surface layer was 70%. The resulting samples were used in the evaluation of the corrosion resistance, the coating adhesion, and the throwing power. The corrosion resistance; 1.7 mm, the coating adhesion; 1.5 mm, and the throwing power; 8.0 μm. The result of the sludge observation was "transparent", and the environmental suitability was "A".

Example 10

The procedure of Example 1 was repeated except that the pH of the surface-treating solution was 10.0 to prepare a metal material with a bismuth coating.

The bismuth was present generally as metal bismuth, and the coating weight was 25 mg/m$^2$. Percentage of bismuth atoms in the surface layer was 30%. The resulting samples were used in the evaluation of the corrosion resistance, the coating adhesion, and the throwing power. The corrosion resistance; 1.7 mm, the coating adhesion; 1.5 mm, and the throwing power; 7.8 μm. The result of the sludge observation was "transparent", and the environmental suitability was "A".

Example 11

The procedure of Example 1 was repeated except that 2400 ppm of sodium saccharinate was also added as a brightener to the surface-treating solution used in Example 1 to prepare a metal material with a bismuth coating.

The bismuth was present generally as metal bismuth, and the coating weight was 80 mg/m$^2$. Percentage of bismuth atoms in the surface layer was 85%. The resulting samples were used in the evaluation of the corrosion resistance, the coating adhesion, and the throwing power. The corrosion resistance; 1.0 mm, the coating adhesion; 1.0 mm, and the throwing power; 9.7 μm. The result of the sludge observation was "transparent", and the environmental suitability was "A".

Example 12

The procedure of Example 1 was repeated except that 1500 ppm of vanillin was also added as a brightener to the surface-treating solution used in Example 1 to prepare a metal material with a bismuth coating.

The bismuth was present generally as metal bismuth, and the coating weight was 85 mg/m$^2$. Percentage of bismuth atoms in the surface layer was 85%. The resulting samples were used in the evaluation of the corrosion resistance, the coating adhesion, and the throwing power. The corrosion resistance; 0.8 mm, the coating adhesion; 0.8 mm, and the throwing power; 9.5 μm. The result of the sludge observation was "transparent", and the environmental suitability was "A".

Example 13

The procedure of Example 1 was repeated except that 8000 ppm of butynediol was also added as a brightener to the surface-treating solution used in Example 1 to prepare a metal material with a bismuth coating.

The bismuth was present generally as metal bismuth, and the coating weight was 80 mg/m$^2$. Percentage of bismuth atoms in the surface layer was 88%. The resulting samples were used in the evaluation of the corrosion resistance, the coating adhesion, and the throwing power. The corrosion resistance; 1.1 mm, the coating adhesion; 1.0 mm, and the throwing power; 9.0 μm. The result of the sludge observation was "transparent", and the environmental suitability was "A".

Example 14

The procedure of Example 1 was repeated except that 230 ppm of sodium naphthalenesulfonate was also added as a brightener to the surface-treating solution used in Example 1 to prepare a metal material with a bismuth coating.

The bismuth was present generally as metal bismuth, and the coating weight was 72 mg/m$^2$. Percentage of bismuth atoms in the surface layer was 75%. The resulting samples were used in the evaluation of the corrosion resistance, the coating adhesion, and the throwing power. The corrosion resistance; 1.2 mm, the coating adhesion; 1.0 mm, and the throwing power; 9.0 μm. The result of the sludge observation was "transparent", and the environmental suitability was "A".

Example 15

The procedure of Example 1 was repeated except that 2300 ppm of sodium naphthalenesulfonate was also added as a brightener to the surface-treating solution used in Example 1 to prepare a metal material with a bismuth coating.

The bismuth was present generally as metal bismuth, and the coating weight was 70 mg/m$^2$. Percentage of bismuth atoms in the surface layer was 77%. The resulting samples were used in the evaluation of the corrosion resistance, the coating adhesion, and the throwing power. The corrosion resistance; 1.2 mm, the coating adhesion; 1.0 mm, and the throwing power; 9.0 μm. The result of the sludge observation was "transparent", and the environmental suitability was "A".

Example 16

The procedure of Example 1 was repeated except that 23000 ppm of sodium naphthalenesulfonate was also added as a brightener to the surface-treating solution used in Example 1 to prepare a metal material with a bismuth coating.

The bismuth was present generally as metal bismuth, and the coating weight was 70 mg/m$^2$. Percentage of bismuth atoms in the surface layer was 75%. The resulting samples were used in the evaluation of the corrosion resistance, the coating adhesion, and the throwing power. The corrosion resistance; 1.0 mm, the coating adhesion; 1.0 mm, and the throwing power; 9.0 μm. The result of the sludge observation was "transparent", and the environmental suitability was "A".

Example 17

Bismuth nitrate corresponding to the bismuth concentration of 200 ppm and hydrofluoric acid corresponding to the concentration of 200 ppm were dissolved in water. To this solution, 840 ppm of HEDTA and 700 ppm of tiron (monohydrate) were added and the mixture was stirred until it became transparent. The pH of the resulting solution was adjusted to 3.5 with ammonia, and after adjusting the temperature to 37° C., a number of SPC metal plates were dipped in the solution for 180 seconds. After removing the metal plates from the solution, they were rinsed and dried at room temperature to obtain the metal plates with a bismuth coating. The bismuth was present generally as metal bismuth, and the coating weight was 120 mg/m$^2$. Percentage of bismuth atoms in the surface layer was 97%.

The resulting samples were used in the evaluation of the corrosion resistance, the coating adhesion, and the throwing power. The corrosion resistance; 0.8 mm, the coating adhesion; 0.8 mm, and the throwing power; 9.8 μm. In the sludge observation, the solution used for the chemical conversion exhibited blue color characteristic to the complex between iron and tiron but no precipitation was noted. The environmental suitability was "A".

Example 18

Bismuth nitrate corresponding to the bismuth concentration of 200 ppm and hydrofluoric acid corresponding to the concentration of 200 ppm were dissolved in water. To this solution, 900 ppm of EDTA and 1600 ppm of tiron (monohydrate) were added and the mixture was stirred until it became transparent. The pH of the resulting solution was adjusted to 3.5 with ammonia, and after adjusting the temperature to 37° C., a number of SPC metal plates were dipped in the solution for 180 seconds. After removing the metal plates from the solution, they were rinsed and dried at room temperature to obtain the metal plates with a bismuth coating. The bismuth was present generally as metal bismuth, and the coating weight was 120 mg/m$^2$. Percentage of bismuth atoms in the surface layer was 97%.

The resulting samples were used in the evaluation of the corrosion resistance, the coating adhesion, and the throwing power. The corrosion resistance; 0.8 mm, the coating adhesion; 0.8 mm, and the throwing power; 9.8 μm. In the sludge observation, the solution exhibited blue color characteristic to the complex between iron and tiron but no precipitation was noted. The environmental suitability was "A".

Example 19

The procedure of Example 1 was repeated except that the EDTA was used for the ligand in Example 1 at a concentration of 300 ppm to prepare a metal material with a bismuth coating.

The bismuth was present generally as metal bismuth, and the coating weight was 140 mg/m$^2$. Percentage of bismuth atoms in the surface layer was 95%. The resulting samples were used in the evaluation of the corrosion resistance, the coating adhesion, and the throwing power. The corrosion resistance; 0.8 mm, the coating adhesion; 1.0 mm, and the throwing power; 8.8 μm. The result of the sludge observation was "transparent", and the environmental suitability was "A".

Example 20

The procedure of Example 19 was repeated except that the EDTA used for the ligand was at a concentration of 900 ppm to prepare a metal material with a bismuth coating.

The bismuth was present generally as metal bismuth, and the coating weight was 120 mg/m$^2$. Percentage of bismuth atoms in the surface layer was 88%. The resulting samples were used in the evaluation of the corrosion resistance, the coating adhesion, and the throwing power. The corrosion resistance; 1.0 mm, the coating adhesion; 1.1 mm, and the throwing power; 8.8 μm. The result of the sludge observation was "transparent", and the environmental suitability was "A".

Example 21

The procedure of Example 19 was repeated except that the EDTA used for the ligand was at a concentration of 2700 ppm to prepare a metal material with a bismuth coating.

The bismuth was present generally as metal bismuth, and the coating weight was 90 mg/m$^2$. Percentage of bismuth atoms in the surface layer was 85%. The resulting samples were used in the evaluation of the corrosion resistance, the coating adhesion, and the throwing power. The corrosion resistance; 1.1 mm, the coating adhesion; 1.0 mm, and the throwing power; 8.7 μm. The result of the sludge observation was "transparent", and the environmental suitability was "A".

Example 22

The procedure of Example 1 was repeated except that the HEDTA used for the ligand in Example 1 was replaced with NTA, and NTA was used at a concentration of 200 ppm to prepare a metal material with a bismuth coating.

The bismuth was present generally as metal bismuth, and the coating weight was 130 mg/m$^2$. Percentage of bismuth atoms in the surface layer was 80%. The resulting samples were used in the evaluation of the corrosion resistance, the coating adhesion, and the throwing power. The corrosion resistance; 1.0 mm, the coating adhesion; 1.2 mm, and the throwing power; 8.5 μm. The result of the sludge observation was "transparent", and the environmental suitability was "A".

Example 23

The procedure of Example 22 was repeated except that the NTA used for the ligand was at a concentration of 600 ppm to prepare a metal material with a bismuth coating.

The bismuth was present generally as metal bismuth, and the coating weight was 100 mg/m$^2$. Percentage of bismuth atoms in the surface layer was 75%. The resulting samples were used in the evaluation of the corrosion resistance, the coating adhesion, and the throwing power. The corrosion resistance; 1.3 mm, the coating adhesion; 1.5 mm, and the throwing power; 8.4 μm. The result of the sludge observation was "transparent", and the environmental suitability was "A".

Example 24

The procedure of Example 1 was repeated except that the ligand was at a concentration of 280 ppm to prepare a metal material with a bismuth coating.

The bismuth was present generally as metal bismuth, and the coating weight was 140 mg/m$^2$. Percentage of bismuth atoms in the surface layer was 90%. The resulting samples were used in the evaluation of the corrosion resistance, the coating adhesion, and the throwing power. The corrosion resistance; 1.0 mm, the coating adhesion; 1.0 mm, and the throwing power; 9.0 μm. The result of the sludge observation was "transparent", and the environmental suitability was "A".

Example 25

The procedure of Example 1 was repeated except that the ligand was at a concentration of 1680 ppm to prepare a metal material with a bismuth coating.

The bismuth was present generally as metal bismuth, and the coating weight was 100 mg/m$^2$. Percentage of bismuth atoms in the surface layer was 88%. The resulting samples were used in the evaluation of the corrosion resistance, the coating adhesion, and the throwing power. The corrosion resistance; 1.0 mm, the coating adhesion; 1.2 mm, and the throwing power; 8.5 μm. The result of the sludge observation was "transparent", and the environmental suitability was "A".

Example 26

The procedure of Example 1 was repeated except that Al of an amount to be 150 ppm was added in the form of aluminum nitrate to the surface-treating solution used in Example 1 and hydrofluoric acid was also added at the amount that forms $AlF_3$ to prepare a metal material with a bismuth coating. This amount of hydrofluoric acid corresponds to the hydrofluoric acid concentration of about 535 ppm. The fluoride ion derived from the hydrofluoric acid also functions as a ligand for Al.

The bismuth was present generally as metal bismuth, and the coating weight was 90 mg/m$^2$. Percentage of bismuth atoms in the surface layer was 70%. The resulting samples were used in the evaluation of the corrosion resistance, the coating adhesion, and the throwing power. The corrosion resistance; 1.5 mm, the coating adhesion; 1.2 mm, and the throwing power; 8.5 μm. The result of the sludge observation was "transparent", and the environmental suitability was "A".

Example 27

The procedure of Example 1 was repeated except that Y of an amount to be 10 ppm was added in the form of yttrium nitrate to the surface-treating solution used in Example 1 and hydrofluoric acid was also added at the amount that forms $YF_3$ to prepare a metal material with a bismuth coating. This amount of hydrofluoric acid substantially corresponds to the hydrofluoric acid concentration of 206 ppm.

The bismuth was present generally as metal bismuth, and the coating weight was 90 mg/m$^2$. Percentage of bismuth atoms in the surface layer was 65%. The resulting samples were used in the evaluation of the corrosion resistance, the coating adhesion, and the throwing power. The corrosion resistance; 1.5 mm, the coating adhesion; 1.5 mm, and the throwing power; 8.8 μm. In the sludge observation, the solution was slightly turbid and white due to the yttrium fluoride, and not because of the metal material, and therefore, the environmental suitability was evaluated "B".

Example 28

The procedure of Example 1 was repeated except that Sb of an amount to be 5 ppm was added in the form of potassium antymonyl tartarate to prepare a metal material with a bismuth coating.

The bismuth was present generally as metal bismuth, and the coating weight was 70 mg/m$^2$. Percentage of bismuth atoms in the surface layer was 50%. The resulting samples were used in the evaluation of the corrosion resistance, the coating adhesion, and the throwing power. The corrosion resistance; 1.8 mm, the coating adhesion; 1.7 mm, and the throwing power; 8.0 μm. The result of the sludge observation was "slightly turbid", and the environmental suitability was "A".

Example 29

The procedure of Example 1 was repeated except that fluorozirconium acid of an amount to be 300 ppm was also added as an etchant to the surface-treating solution used in Example 1 to prepare a metal material with a bismuth coating.

The bismuth was present generally as metal bismuth, and the coating weight was 65 mg/m$^2$. Percentage of bismuth atoms in the surface layer was 48%. The resulting samples were used in the evaluation of the corrosion resistance, the coating adhesion, and the throwing power. The corrosion resistance; 1.3 mm, the coating adhesion; 1.2 mm, and the throwing power; 8.5 μm. The result of the sludge observation was "transparent", and the environmental suitability was "A".

Example 30

The procedure of Example 1 was repeated except that the surface-treating solution was at a temperature of 43° C. to prepare a metal material with a bismuth coating.

The bismuth was present generally as metal bismuth, and the coating weight was 130 mg/m$^2$. Percentage of bismuth atoms in the surface layer was 95%. The resulting samples were used in the evaluation of the corrosion resistance, the coating adhesion, and the throwing power. The corrosion resistance; 0.8 mm, the coating adhesion; 1.0 mm, and the throwing power; 9.2 μm. The result of the sludge observation was "transparent", and the environmental suitability was "A".

Example 31

The procedure of Example 1 was repeated except that the surface-treating solution was at a temperature of 50° C. to prepare a metal material with a bismuth coating.

The bismuth was present generally as metal bismuth, and the coating weight was 140 mg/m$^2$. Percentage of bismuth atoms in the surface layer was 95%. The resulting samples were used in the evaluation of the corrosion resistance, the coating adhesion, and the throwing power. The corrosion resistance; 1.0 mm, the coating adhesion; 1.2 mm, and the throwing power; 9.0 μm. The result of the sludge observation was "transparent", and the environmental suitability was "A".

Example 32

Chemical conversion was conducted by repeating the procedure of Example 1 and the coating was accomplished by solvent coating. More specifically, a solvent coating composition (CLEAN AMILAC manufactured by Kansai Paint Co., Ltd.) was coated on the metal material with a bismuth coating obtained by repeating the procedure of Example 1, and the coating was dried at 130° C. for 25 minutes to form a coating having a thickness of 30 μm.

The bismuth was present generally as metal bismuth, and the coating weight was 120 mg/m$^2$. Percentage of bismuth atoms in the surface layer was 97%. The resulting samples were used in the evaluation of the corrosion resistance and the coating adhesion. The corrosion resistance; 1.5 mm, the result of the sludge observation was "transparent", and the environmental suitability was "A".

Example 33

The procedure of Example 1 was repeated except that the metal material was GA to prepare a metal material with a bismuth coating.

The bismuth was present generally as metal bismuth, and the coating weight was 200 mg/m$^2$. Percentage of bismuth atoms in the surface layer was 97%. The resulting samples were used in the evaluation of the corrosion resistance, the coating adhesion, and the throwing power. The corrosion resistance; 0.5 mm, the coating adhesion; 0.6 mm, and the throwing power; 10.2 μm. The result of the sludge observation was "transparent", and the environmental suitability was "A".

Example 34

The procedure of Example 11 was repeated except that the metal material was GA to prepare a metal material with a bismuth coating.

The bismuth was present generally as metal bismuth, and the coating weight was 180 mg/m$^2$. Percentage of bismuth atoms in the surface layer was 95%. The resulting samples were used in the evaluation of the corrosion resistance, the coating adhesion, and the throwing power. The corrosion resistance; 0.5 mm, the coating adhesion; 0.5 mm, and the throwing power; 9.8 μm. The result of the sludge observation was "transparent", and the environmental suitability was "A".

Example 35

The procedure of Example 11 was repeated except that the metal material was Al to prepare a metal material with a bismuth coating.

The bismuth was present generally as metal bismuth, and the coating weight was 90 mg/m$^2$. Percentage of bismuth atoms in the surface layer was 75%. The resulting samples were used in the evaluation of the corrosion resistance, the coating adhesion, and the throwing power. The corrosion resistance; 0.5 mm, the coating adhesion; 0.5 mm, and the throwing power; 8.9 μm. The result of the sludge observation was "transparent", and the environmental suitability was "A".

Comparative Example 1

SPC was dipped in a 3.0 g/L solution of a surface adjusting agent ("PREPALENE X" manufactured by Nihon Parkerizing Co., Ltd.) at room temperature for 30 seconds, and then, in a 50 g/L aqueous solution of zinc phosphate chemical conversion agent ("PALBOND SX35" manufactured by Nihon Parkerizing Co., Ltd.) at a temperature of 35° C. for 120 seconds. After removing from the solution, the metal plate was rinsed and dried at room temperature to produce a metal plate having 2.2 g/m$^2$ of zinc phosphate chemical conversion film. The resulting samples were used in the evaluation of the corrosion resistance, the coating adhesion, and the throwing power. The corrosion resistance; 2.0 mm, the coating adhesion; 1.0 mm, and the throwing power; 10.0 μm.

While coating ability and throwing power were excellent, the solution contained a large amount of heavy metal and phosphoric acid, and the sludge was also generated at a large amount.

Comparative Example 2

This Example was conducted by referring to Example 1 of Patent Literature 1. The surface-treating solution was prepared by incorporating fluorozirconic acid at a Zr concentration of 250 ppm and zinc nitrate at a Zn concentration of 500 ppm, and carefully adjusting the pH to 4 with diluted sodium hydroxide so as not to generate the precipitation of zirconium hydrate. This solution was heated to 40° C., and the SPC plate having its surface cleaned was dipped in the solution for 60 seconds. After removing the plate from the solution, the solution was washed by spraying tap water for 30 seconds and spraying deionized water for 30 seconds, and dried at room temperature. A metal material with a zirconium coating as in the case of Example 1 of the Patent Literature 1 was thereby produced. The coating had a coating weight of 45 mg/m$^2$.

The resulting samples were used in the evaluation of the corrosion resistance, the coating adhesion, and the throwing power. The corrosion resistance; 1.5 mm, the coating adhesion; 1.2 mm, and the throwing power, 2.0 μm. The result of the sludge observation was "transparent", and the environmental suitability was "A".

While coating ability and environmental suitability were excellent, the sample suffered from the poor throwing power as described above.

Comparative Example 3

Chemical conversion was conducted by repeating the procedure of Comparative Example 1 and the coating was accomplished by solvent coating. More specifically, as in the case of Comparative Example 1, SPC was dipped in a 3.0 g/L solution of a surface-adjusting agent ("PREPALENE X" manufactured by Nihon Parkerizing Co., Ltd.) at room temperature for 30 seconds, and then, in a 50 g/L aqueous solution of zinc phosphate chemical conversion agent ("PALBOND SX35" manufactured by Nihon Parkerizing Co., Ltd.) at a temperature of 35° C. for 120 seconds. After removing from the solution, the metal plate was rinsed and dried at 80° C. for 10 minutes to produce a metal plate having 2.2 g/m$^2$ of zinc phosphate chemical conversion film. A solvent coating composition (CLEAN AMILAC manufactured by Kansai Paint Co., Ltd.) was coated on the resulting zinc phosphate metal material, and the coating was dried at 130° C. for 25 minutes to form a coating having a thickness of 30 μm. The resulting samples were used in the evaluation of the corrosion resistance, and the corrosion resistance, 1.8 mm.

Despite the excellent coating ability, the solution contained a large amount of heavy metal and phosphoric acid as previously discussed, and the sludge was also generated at a large amount.

TABLE 1

| Ex. | Bi conc. | Ligand (L1) | L1 conc. | Ligand (L2) | L2 conc. | Brightener | Brightener conc. | Etchant |
|---|---|---|---|---|---|---|---|---|
| 1 | 200 ppm | HEDTA | 840 ppm | — | — | None | — | HF |
| 2 | 100 ppm | HEDTA | 840 ppm | — | — | None | — | HF |
| 3 | 1000 ppm | HEDTA | 1400 ppm | — | — | None | — | HF |
| 4 | 200 ppm | HEDTA | 840 ppm | — | — | None | — | HF |
| 5 | 200 ppm | HEDTA | 840 ppm | — | — | None | — | HF |
| 6 | 200 ppm | HEDTA | 840 ppm | — | — | None | — | HF |
| 7 | 200 ppm | HEDTA | 840 ppm | — | — | None | — | HF |
| 8 | 200 ppm | HEDTA | 840 ppm | — | — | None | — | HF |
| 9 | 200 ppm | HEDTA | 840 ppm | — | — | None | — | HF |
| 10 | 200 ppm | HEDTA | 840 ppm | — | — | None | — | HF |
| 11 | 200 ppm | HEDTA | 840 ppm | — | — | Sodium saccharinate | 2400 ppm | HF |
| 12 | 200 ppm | HEDTA | 840 ppm | — | — | Vanillin | 1500 ppm | HF |
| 13 | 200 ppm | HEDTA | 840 ppm | — | — | Butynediol | 8000 ppm | HF |
| 14 | 200 ppm | HEDTA | 840 ppm | — | — | Sodium naphthalene-sulfonate | 230 ppm | HF |
| 15 | 200 ppm | HEDTA | 840 ppm | — | — | Sodium naphthalene-sulfonate | 2300 ppm | HF |
| 16 | 200 ppm | HEDTA | 840 ppm | — | — | Sodium naphthalene-sulfonate | 23000 ppm | HF |
| 17 | 200 ppm | HEDTA | 840 ppm | Tiron (mono-hydrate) | 700 ppm | None | — | HF |
| 18 | 200 ppm | EDTA | 900 ppm | Tiron (mono-hydrate) | 1600 ppm | None | — | HF |
| 19 | 200 ppm | EDTA | 300 ppm | — | — | None | — | HF |
| 20 | 200 ppm | EDTA | 900 ppm | — | — | None | — | HF |
| 21 | 200 ppm | EDTA | 2700 ppm | — | — | None | — | HF |
| 22 | 200 ppm | NTA | 200 ppm | — | — | None | — | HF |
| 23 | 200 ppm | NTA | 600 ppm | — | — | None | — | HF |
| 24 | 200 ppm | HEDTA | 280 ppm | — | — | None | — | HF |
| 25 | 200 ppm | HEDTA | 1680 ppm | — | — | None | — | HF |
| 26 | 200 ppm | HEDTA | 840 ppm | HF is also ligand of Al | | None | — | HF |
| 27 | 200 ppm | HEDTA | 840 ppm | — | — | None | — | HF |
| 28 | 200 ppm | HEDTA | 840 ppm | — | — | None | — | HF |
| 29 | 200 ppm | HEDTA | 840 ppm | — | — | None | — | $H_2ZrF_6$ |
| 30 | 200 ppm | HEDTA | 840 ppm | — | — | None | — | HF |
| 31 | 200 ppm | HEDTA | 840 ppm | — | — | None | — | HF |
| 32 | 200 ppm | HEDTA | 840 ppm | — | — | None | — | HF |
| 33 | 200 ppm | HEDTA | 840 ppm | — | — | None | — | HF |
| 34 | 200 ppm | HEDTA | 840 ppm | — | — | Sodium saccharinate | 2400 ppm | HF |
| 35 | 200 ppm | HEDTA | 840 ppm | — | — | Sodium saccharinate | 2400 ppm | HF |

TABLE 1-continued

| Comp. Ex. | |
|---|---|
| 1 | Zinc phosphate |
| 2 | Zirconium chemical conversion |
| 3 | Zinc phosphate |

| | Etchant conc. | Metal added | Conc. of added metal | pH | Temp. | Time | Coating type | Coating thickness | Steel type |
|---|---|---|---|---|---|---|---|---|---|
| Ex. | | | | | | | | | |
| 1 | 200 ppm | None | — | 3.5 | 37° C. | 180 sec | EP | 20 μm | SPC |
| 2 | 200 ppm | None | — | 3.5 | 37° C. | 180 sec | EP | 20 μm | SPC |
| 3 | 200 ppm | None | — | 3.5 | 37° C. | 180 sec | EP | 20 μm | SPC |
| 4 | 200 ppm | None | — | 3.5 | 37° C. | 60 sec | EP | 20 μm | SPC |
| 5 | 200 ppm | None | — | 3.5 | 37° C. | 120 sec | EP | 20 μm | SPC |
| 6 | 200 ppm | None | — | 3.5 | 37° C. | 300 sec | EP | 20 μm | SPC |
| 7 | 200 ppm | None | — | 2.0 | 37° C. | 180 sec | EP | 20 μm | SPC |
| 8 | 200 ppm | None | — | 4.0 | 37° C. | 180 sec | EP | 20 μm | SPC |
| 9 | 200 ppm | None | — | 7.0 | 37° C. | 180 sec | EP | 20 μm | SPC |
| 10 | 200 ppm | None | — | 10.0 | 37° C. | 180 sec | EP | 20 μm | SPC |
| 11 | 200 ppm | None | — | 3.5 | 37° C. | 180 sec | EP | 20 μm | SPC |
| 12 | 200 ppm | None | — | 3.5 | 37° C. | 180 sec | EP | 20 μm | SPC |
| 13 | 200 ppm | None | — | 3.5 | 37° C. | 180 sec | EP | 20 μm | SPC |
| 14 | 200 ppm | None | — | 3.5 | 37° C. | 180 sec | EP | 20 μm | SPC |
| 15 | 200 ppm | None | — | 3.5 | 37° C. | 180 sec | EP | 20 μm | SPC |
| 16 | 200 ppm | None | — | 3.5 | 37° C. | 180 sec | EP | 20 μm | SPC |
| 17 | 200 ppm | None | — | 3.5 | 37° C. | 180 sec | EP | 20 μm | SPC |
| 18 | 200 ppm | None | — | 3.5 | 37° C. | 180 sec | EP | 20 μm | SPC |
| 19 | 200 ppm | None | — | 3.5 | 37° C. | 180 sec | EP | 20 μm | SPC |
| 20 | 200 ppm | None | — | 3.5 | 37° C. | 180 sec | EP | 20 μm | SPC |
| 21 | 200 ppm | None | — | 3.5 | 37° C. | 180 sec | EP | 20 μm | SPC |
| 22 | 200 ppm | None | — | 3.5 | 37° C. | 180 sec | EP | 20 μm | SPC |
| 23 | 200 ppm | None | — | 3.5 | 37° C. | 180 sec | EP | 20 μm | SPC |
| 24 | 200 ppm | None | — | 3.5 | 37° C. | 180 sec | EP | 20 μm | SPC |
| 25 | 200 ppm | None | — | 3.5 | 37° C. | 180 sec | EP | 20 μm | SPC |
| 26 | 535 ppm | Al | 150 ppm | 3.5 | 37° C. | 180 sec | EP | 20 μm | SPC |
| 27 | 206 ppm | Y | 10 ppm | 3.5 | 37° C. | 180 sec | EP | 20 μm | SPC |
| 28 | 200 ppm | Sb | 5 ppm | 3.5 | 37° C. | 180 sec | EP | 20 μm | SPC |
| 29 | 300 ppm | None | — | 3.5 | 37° C. | 180 sec | EP | 20 μm | SPC |
| 30 | 200 ppm | None | — | 3.5 | 42° C. | 180 sec | EP | 20 μm | SPC |
| 31 | 200 ppm | None | — | 3.5 | 50° C. | 180 sec | EP | 20 μm | SPC |
| 32 | 200 ppm | None | — | 3.5 | 37° C. | 180 sec | SP | 30 μm | SPC |
| 33 | 200 ppm | None | — | 3.5 | 37° C. | 180 sec | EP | 20 μm | GA |
| 34 | 200 ppm | None | — | 3.5 | 37° C. | 300 sec | EP | 20 μm | GA |
| 35 | 200 ppm | None | — | 3.5 | 37° C. | 300 sec | EP | 20 μm | Al |
| Comp. Ex. | | | | | | | | | |
| 1 | Zinc phosphate | | | — | 35° C. | 120 sec | EP | 20 μm | SPC |
| 2 | Zirconium chemical conversion | | | 4.0 | 40° C. | 120 sec | EP | 20 μm | SPC |
| 3 | Zinc phosphate | | | — | 35° C. | 120 sec | SP | 30 μm | SPC |

Conc.: Concentration,
EP: Electrodeposition paint,
SP: Solvent paint

TABLE 2

| | Bi coating weight mg/m$^2$ | Bi percentage % | Corrosion resistance: Salt spray test (mm) | Corrosion resistance: Evaluation | Coating adhesion: Salt dip test (mm) | Coating adhesion: Evaluation | Throwing power: Thickness of electrodeposited coating on surface G (μm) | Throwing power: Evaluation | Environmental suitability: Sludge generation | Environmental suitability: Evaluation |
|---|---|---|---|---|---|---|---|---|---|---|
| Ex. | | | | | | | | | | |
| 1 | 120 | 97 | 0.8 | B | 0.8 | B | 9.8 | B | No | A |
| 2 | 60 | 42 | 1.2 | B | 0.8 | B | 9.0 | B | No | A |
| 3 | 500 | 95 | 1.2 | B | 0.8 | B | 11.0 | B | No | A |
| 4 | 40 | 38 | 1.4 | B | 1.6 | B | 8.8 | B | No | A |

TABLE 2-continued

| | Bi coating weight mg/m$^2$ | Bi percentage % | Corrosion resistance: Salt spray test (mm) | Corrosion resistance: Evaluation | Coating adhesion: Salt dip test (mm) | Coating adhesion: Evaluation | Throwing power: Thickness of electrodeposited coating on surface G (μm) | Throwing power: Evaluation | Environmental suitability: Sludge generation | Environmental suitability: Evaluation |
|---|---|---|---|---|---|---|---|---|---|---|
| 5 | 80 | 70 | 1.2 | B | 1.3 | B | 9.0 | B | No | A |
| 6 | 450 | 95 | 1.0 | B | 0.8 | B | 10.5 | B | No | A |
| 7 | 80 | 60 | 1.2 | B | 1.4 | B | 8.5 | B | No | A |
| 8 | 100 | 85 | 1.0 | B | 1.1 | B | 9.0 | B | No | A |
| 9 | 40 | 70 | 1.7 | B | 1.5 | B | 8.0 | B | No | A |
| 10 | 25 | 30 | 1.7 | B | 1.5 | B | 7.8 | B | No | A |
| 11 | 80 | 85 | 1.0 | B | 1.0 | B | 9.7 | B | No | A |
| 12 | 85 | 85 | 0.8 | B | 0.8 | B | 9.5 | B | No | A |
| 13 | 80 | 88 | 1.1 | B | 1.0 | B | 9.0 | B | No | A |
| 14 | 72 | 75 | 1.2 | B | 1.0 | B | 9.0 | B | No | A |
| 15 | 70 | 77 | 1.0 | B | 1.0 | B | 9.0 | B | No | A |
| 16 | 70 | 75 | 1.0 | B | 1.0 | B | 9.0 | B | No | A |
| 17 | 120 | 97 | 0.8 | B | 0.8 | B | 9.7 | B | No | A |
| 18 | 120 | 97 | 0.8 | B | 0.8 | B | 9.8 | B | No | A |
| 19 | 140 | 95 | 0.8 | B | 1.0 | B | 8.8 | B | No | A |
| 20 | 120 | 88 | 1.0 | B | 1.1 | B | 8.8 | B | No | A |
| 21 | 90 | 85 | 1.1 | B | 1.0 | z | 8.7 | B | No | A |
| 22 | 130 | 80 | 1.0 | B | 1.2 | B | 8.5 | B | No | A |
| 23 | 100 | 75 | 1.3 | B | 1.5 | B | 8.4 | B | No | A |
| 24 | 140 | 90 | 1.0 | B | 1.0 | B | 9.0 | B | No | A |
| 25 | 100 | 88 | 1.0 | B | 1.2 | B | 8.5 | B | No | A |
| 26 | 90 | 70 | 1.5 | B | 1.2 | B | 8.5 | B | No | A |
| 27 | 90 | 65 | 1.5 | B | 1.5 | B | 8.8 | B | No | B |
| 28 | 70 | 50 | 1.8 | B | 1.7 | B | 8.0 | B | No | A |
| 29 | 65 | 48 | 1.3 | B | 1.2 | B | 8.5 | B | No | A |
| 30 | 130 | 95 | 0.8 | B | 1.0 | B | 9.2 | B | No | A |
| 31 | 140 | 95 | 1.0 | B | 1.2 | B | 9.0 | B | No | A |
| 32 | 120 | 97 | 1.5 | B | — | — | — | — | No | A |
| 33 | 200 | 97 | 0.5 | B | 0.6 | B | 10.2 | B | No | A |
| 34 | 180 | 95 | 0.5 | B | 0.5 | B | 9.8 | B | No | A |
| 35 | 90 | 75 | 0.5 | B | 0.5 | B | 8.9 | B | No | A |
| Comp. Ex. | | | | | | | | | | |
| 1 | 2200 Zinc phosphate | — | 2.0 | B | 1.0 | B | 10.0 | B | Yes | D |
| 2 | 45 Zirconium | — | 1.5 | B | 1.2 | B | 2.0 | D | No | A |
| 3 | 2200 Zinc phosphate | — | 1.8 | B | — | — | — | — | Yes | D |

<Surface Conditions of the Metal Material with a Bismuth Coating, and the Relation Between the Treatment Time and Coating Weight>

Figure 3:
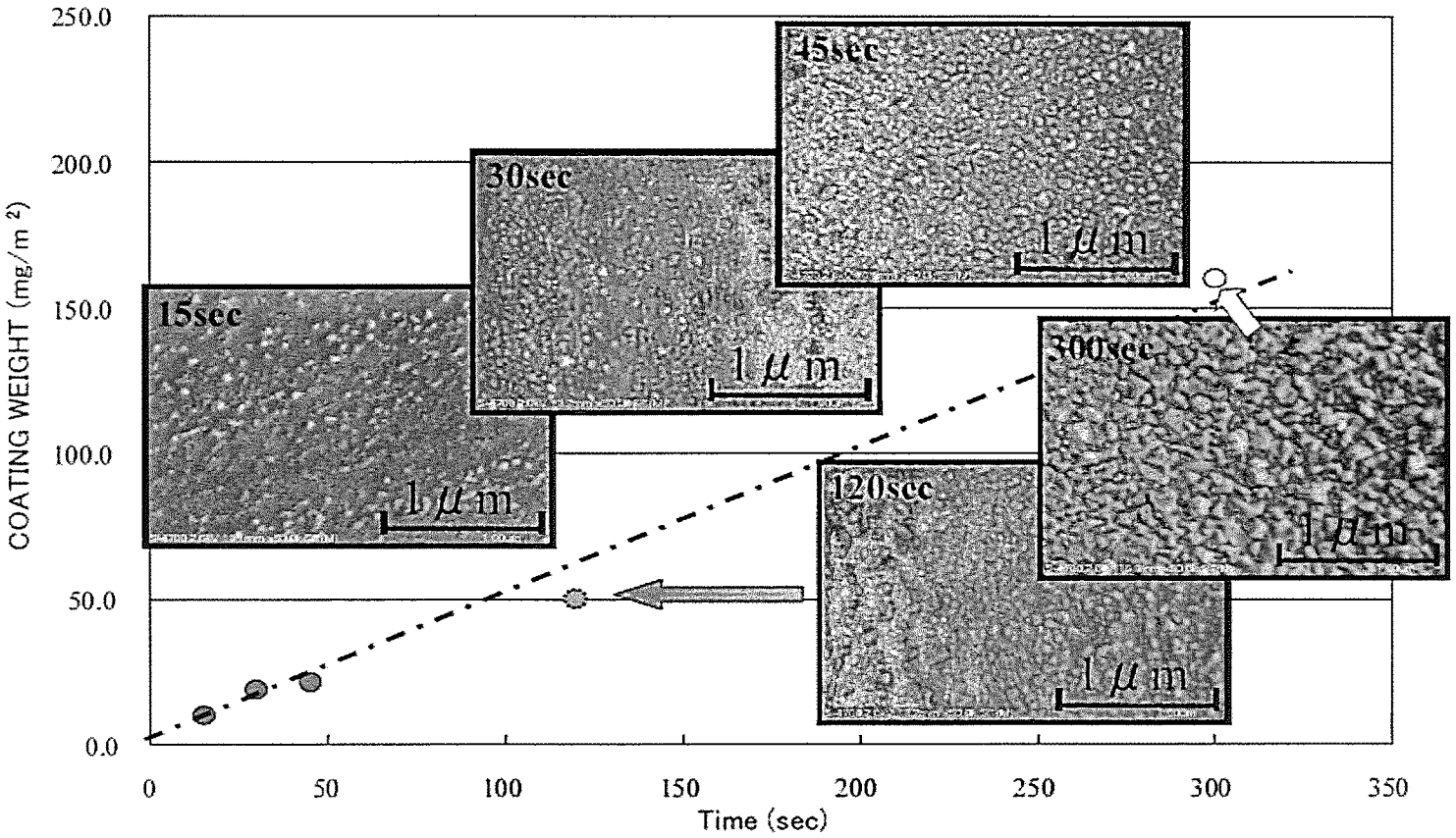
FIG. 3 shows FE-SEM photographs of the surface of the metal materials with a bismuth coating produced in Examples 34 to 38, and a graph showing the coating weight in relation to the time of the treatment.

The metal materials with a bismuth coating produced in Examples 34 to 38 were observed by field emission scanning electron microscope (FE-SEM) at a magnification of 30000. FIG. 3 shows the pictures of the surface of the metal materials with a bismuth coating of Example 34 to 38 taken by FE-SEM, and a graph showing the relation between the treatment time and the coating weight.

Examples 36 to 40

The procedure of Example 11 was repeated except that the surface-treating solution used in Example 11 was adjusted to a pH of 3.7, and the treatment was conducted for 15 seconds (Example 36), 30 seconds (Example 37), 45 seconds (Example 38), 120 seconds (Example 39), and 300 seconds (Example 40), respectively, to prepare a metal material with a bismuth coating. Coating weight and percentage of the surface area of the bismuth coating in relation to the surface area of the metal material (coverage) are shown in the following Table 2.

TABLE 3

| Example | Treatment time | Coating weight (mg/m$^2$) | Coverage (%) |
|---|---|---|---|
| 36 | 15 sec. | 11 | 15 |
| 37 | 30 sec. | 24 | 30 |
| 38 | 45 sec. | 28 | 50 |
| 39 | 120 sec. | 50 | 80 |
| 40 | 300 sec. | 163 | 95 or higher |

REFERENCE SIGNS LIST

10 four-plate box
11 hole
12, 13, 14, 15 metal plate
16, 17, 18 polyvinyl chloride plate
21 counter electrode

22 paint

23 coating

What is claimed is:

1. A surface treating solution for use in a chemical conversion of a metal material surface conducted as a pretreatment of a coating, wherein the surface treating solution contains bismuth ions and a first ligand for the bismuth ions in an amount effective to form a bismuth chemical conversion film on the metal surface.

2. The surface treating solution according to claim 1, wherein said coating is by cationic electrodeposition.

3. The surface treating solution according to claim 1, further comprising a brightener.

4. The surface treating solution according to claim 3, wherein the brightener is an organic compound having at least one member selected from the group consisting of an aromatic ring, a sulfone group, a formyl group, a carboxy group and an amino group.

5. The surface treating solution according to claim 3, wherein the solution at the time of the surface treatment contains the brightener at a weight concentration of 10 to 10,000 ppm.

6. The surface treating solution according to claim 3, wherein the first ligand is at least one member selected from the group consisting of an minopolycarboxylic acid and a carboxylic acid, and the solution contains at least one ligand which has a stability for the bismuth ions higher than a stability for an ion of a metal constituting the metal material.

7. The surface treating solution according to claim 3, wherein the first ligand is at least one member selected from the group consisting of an aminopolycarboxylic acid and/e a carboxylic acid, and has a stability for the bismuth ions higher than a stability for an ion of a metal constituting the metal material, and the solution further comprises a second ligand which has a stability for the ion of the metal constituting the metal material higher than a stability for the bismuth ions.

8. The surface treating solution according to claim 3, wherein the solution at the time of the surface treatment contains the bismuth ions at a weight concentration of 5 to 1,000 ppm.

9. The surface treating solution according to claim 3, having a pH of at least 2 and less than 10.5.

10. The surface treating solution according to claim 1, wherein the first ligand is at least one member selected from the group consisting of an aminopolycarboxylic acid and a carboxylic acid, and the solution contains at least one ligand which has a stability for the bismuth ions higher than a stability for an ion of a metal constituting the metal material.

11. The surface treating solution according to claim 1, wherein, the first ligand is an aminopolycarboxylic acid and has a stability for the bismuth ions higher than a stability for an ion of a metal constituting the metal material; and the solution further comprises a second ligand which has a stability for the ion of a metal constituting the metal material higher than a stability for the bismuth ions.

12. The surface treating solution according to claim 1, wherein the solution at the time of the surface treatment contains the bismuth ions at a weight concentration of 5 to 1,000 ppm.

13. The surface treating solution according to claim 12, wherein the solution at the time of the surface treatment contains the first ligand at a weight concentration of 5 to 25,000 ppm.

14. The surface treating solution according to claim 1, having a pH of at least 2 and less than 10.5.

* * * * *